US007723005B2

(12) United States Patent
Akioka et al.

(10) Patent No.: US 7,723,005 B2
(45) Date of Patent: May 25, 2010

(54) LIQUID DEVELOPER

(75) Inventors: Koji Akioka, Nagano (JP); Nobuhiro Miyakawa, Nagano (JP); Takashi Teshima, Nagano (JP); Satoru Miura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 1074 days.

(21) Appl. No.: 11/394,370

(22) Filed: Mar. 29, 2006

(65) Prior Publication Data

US 2006/0234150 A1 Oct. 19, 2006

(30) Foreign Application Priority Data

Mar. 29, 2005 (JP) ..... 2005-096287
Mar. 29, 2005 (JP) ..... 2005-096288
Mar. 30, 2005 (JP) ..... 2005-099984

(51) Int. Cl.
*G03G 9/00* (2006.01)

(52) U.S. Cl. ..... 430/112; 430/115

(58) Field of Classification Search ..... 430/112, 430/115

See application file for complete search history.

(56) References Cited

U.S. PATENT DOCUMENTS 3,857,549 A * 12/1974 Snelling ..... 399/131
2006/0204884 A1* 9/2006 Teshima ..... 430/114

FOREIGN PATENT DOCUMENTS

| | | |
|---|---|---|
| JP | 07-152256 | 6/1995 |
| JP | 11012510 A | 1/1999 |
| JP | 2000162903 A | 6/2000 |
| JP | 2001098197 A | 4/2001 |

* cited by examiner

*Primary Examiner*—Mark F Huff
*Assistant Examiner*—Rachel L Burney
(74) *Attorney, Agent, or Firm*—Hogan & Hartson LLP

(57) ABSTRACT

A liquid developer contains an insulation liquid containing as its main component a glyceride of an unsaturated fatty acid, toner particles dispersed in the insulation liquid; and an oxidation polymerization accelerator for accelerating oxidation polymerization reaction of the glyceride during fixing process of the toner particles. The oxidation polymerization accelerator accelerates the oxidation polymerization reaction by supplying oxygen during the fixing process of the toner particles. The liquid developer may further contain an anti-oxidizing agent. Preferably, the oxidation polymerization accelerator is contained in the insulation liquid being encapsulated.

9 Claims, 10 Drawing Sheets

LIQUID DEVELOPER

CROSS-REFERENCE TO RELATED APPLICATION

This application claims priorities to Japanese Patent Applications No. 2005-96287 filed Mar. 29, 2005, No. 2005-96288 filed Mar. 29, 2005 and No. 2005-99984 filed on Mar. 30. 2005 which are hereby expressly incorporated by reference herein in its entirety.

BACKGROUND OF THE INVENTION

1. Field of the Invention

The present invention relates to a liquid developer.

2. Description of the Prior Art

As a developer used for developing an electrostatic latent image formed on a latent image carrier, there are known two types. One type of such a developer is known as a dry toner which is formed of a material containing a coloring agent such as a pigment or the like and a binder resin, and such a dry toner is used in a dry condition thereof. The other type of such a developer is known as a liquid developer which is obtained by dispersing toner particles into a carrier liquid having electric insulation properties (one example of such a liquid toner is disclosed in JP-A No. 7-152256).

In the developing method using such a dry toner, since a solid state toner is used, there is an advantage in handleability thereof. On the other hand, however, this method involves problems in that contamination is likely to be caused by dispersal of toner powder and toner particles are likely to be massed together in a cartridge. Further, in such a dry toner, since aggregation of toner particles is likely to occur in the producing process thereof, it is difficult to obtain toner particles each having a sufficiently small diameter. This means that it is difficult to form a toner image having high resolution. Furthermore, there is also a problem in that when the size of the toner particle is made to be relatively small, the problems resulted from the powder form of the dry toner described above become more serious.

On the other hand, in the developing method using the liquid developer, since aggregation of toner particles in the liquid developer is effectively prevented, it is possible to use very fine toner particles and it is also possible to use a binder resin having a low softening point (a low softening temperature). As a result, the method using the liquid developer has such advantages as good reproductivity of an image composed of thin lines, good tone reproductivity as well as good reproductivity of colors. Further, the method using the liquid developer is also superior as a method for forming an image at high speed.

However, since the insulation liquid used in the conventional liquid developer is mainly composed of a petroleum-based carbon hydride, there is concern that the insulation liquid may give an adverse affect to environment if it flows out of an image forming apparatus.

Further, normally, when a liquid developer is used, an insulation liquid is adhering to a surface of each toner particle during fixing process of the toner particles. Because of this, in the conventional liquid developer, there is a problem in that such an insulation liquid adhering to the surfaces of the particles lowers a fixing strength of the toner particles.

SUMMARY OF THE PRESENT INVENTION

Accordingly, it is an object of the present invention to provide a liquid developer which has an excellent fixing characteristic and which is also harmless to environment.

In order to achieve the above mentioned object, the present invention is directed to a liquid developer, which comprises an insulation liquid containing as its main component a glyceride of an unsaturated fatty acid; toner particles dispersed in the insulation liquid; and an oxidation polymerization accelerator contained in the insulation liquid for accelerating oxidation polymerization reaction of the glyceride during fixing process of the toner particles.

According to the present invention described above, it is possible to provide a liquid developer which has an excellent fixing characteristic and which is harmless to environment.

In the liquid developer according to the present invention, it is preferred that the oxidation polymerization accelerator includes a metal salt of a fatty acid.

This makes it possible to accelerate oxidation polymerization reaction of the unsaturated fatty acid glyceride during the fixing process while maintaining the stability of the liquid developer during the storage or preservation thereof.

In the liquid developer according to the present invention, it is also preferred that the amount of the oxidation polymerization accelerator contained in the insulation liquid is in the range of 0.01 to 10 wt %.

This makes it possible to progress oxidation polymerization reaction of the unsaturated fatty acid glyceride during the fixing process more reliably while preventing oxidation polymerization reaction from being caused during the storage or preservation of the liquid developer effectively.

In the liquid developer according to the present invention, it is also preferred that the oxidation polymerization accelerator accelerates the oxidation polymerization reaction by supplying oxygen during the fixing process.

This makes it possible to accelerate the oxidation polymerization reaction during the fixing process while prevent oxidation polymerization reaction from being caused during the storage or preservation thereof effectively.

In the liquid developer according to the present invention, it is also preferred that the oxidation polymerization accelerator is contained in the insulation liquid with being encapsulated.

By using the oxidation polymerization accelerator with :being encapsulated, it is possible to prevent oxidation polymerization reaction from being caused during the storage or preservation of the liquid developer more reliably. Further, since the capsules of the oxidation polymerization accelerator are collapsed with a predetermined pressure applied at the fixing process, it is possible to progress the oxidation polymerization reaction of the unsaturated fatty acid glyceride reliably.

In this case, it is preferred that the encapsulation of the oxidation polymerization accelerator is carried out by allowing the oxidation polymerization accelerator to be adsorbed by porous bodies and then coating the porous bodies with polyether.

According to this method, it is possible to obtain the encapsulated oxidation polymerization accelerator easily.

In the liquid developer according to the present invention, it is also preferred that the liquid developer further comprises an antioxidizing agent.

This makes it possible to prevent the oxidation polymerization reaction from being caused during the storage of the liquid developer more reliably.

In the liquid developer according to the present invention, it is also preferred that the amount of the antioxidizing agent contained in the insulation liquid is in the range of 0.01 to 10 wt %.

This makes it possible to prevent the oxidation polymerization reaction of the unsaturated fatty acid glyceride during the storage or preservation of the liquid developer more reliably.

In the liquid developer according to the present invention, it is also preferred that the pyrolysis temperature of the antioxidizing agent is equal to or less than a fixing temperature of the fixing process.

This makes it possible to prevent deterioration of the insulation liquid due to oxidization of the unsaturated fatty acid glyceride during the storage or preservation of the liquid developer more reliably. Further, this also makes it possible for the antioxidizing agent contained in the insulation liquid adhering to the surfaces of the toner particles to be thermally decomposed during the fixing process. As a result, since the effect of the antioxidizing agent is lowered, it is possible to promote the oxidation polymerization reaction of the unsaturated fatty acid glyceride by the oxidation polymerization accelerator.

In this case, it is preferred that the pyrolysis temperature of the antioxidizing agent is equal to or less than 200° C.

This makes it possible for the antioxidizing agent to exhibit its function sufficiently during the storage or preservation of the liquid developer. Further, this also makes it possible to promote the oxidation polymerization reaction of the unsaturated fatty acid glyceride by the oxidation polymerization accelerator during the fixing process since the function of the antioxidizing agent is lowered.

In the liquid developer according to the present invention, it is preferred that the antioxidizing agent includes a vitamin C.

Since a vitamin C is a substance which is harmless to environment, and its oxidative product produced by oxidation thereof gives only small affects to the liquid developer, and thus it is possible to obtain a liquid developer which is more harmless to environment. Further, since a vitamin C is a substance having a relatively low pyrolysis temperature, it can exhibit a function as the antioxidizing agent sufficiently during the storage or preservation while the function as the antioxidizing agent is lowered during the fixing process thereby enabling to promote the oxidation polymerization reaction of the unsaturated fatty acid glyceride by the oxidation polymerization accelerator.

In the liquid developer described above, it is also preferred that the oxidation polymerization accelerator is contained in the insulation liquid with being encapsulated.

Further, in this case, the encapsulation of the oxidation polymerization accelerator is carried out by allowing the oxidation polymerization accelerator to be adsorbed by porous bodies and then coating the porous bodies with polyether.

According to these liquid developers, it is also possible to enjoy the advantages described above.

These and other objects, structures and effects of the present invention will be more apparent when the following detailed description of the preferred embodiments and the examples will be considered taken in conjunction with the appended drawings.

DETAILED DESCRIPTION OF THE PREFERRED EMBODIMENTS

Figure 1:
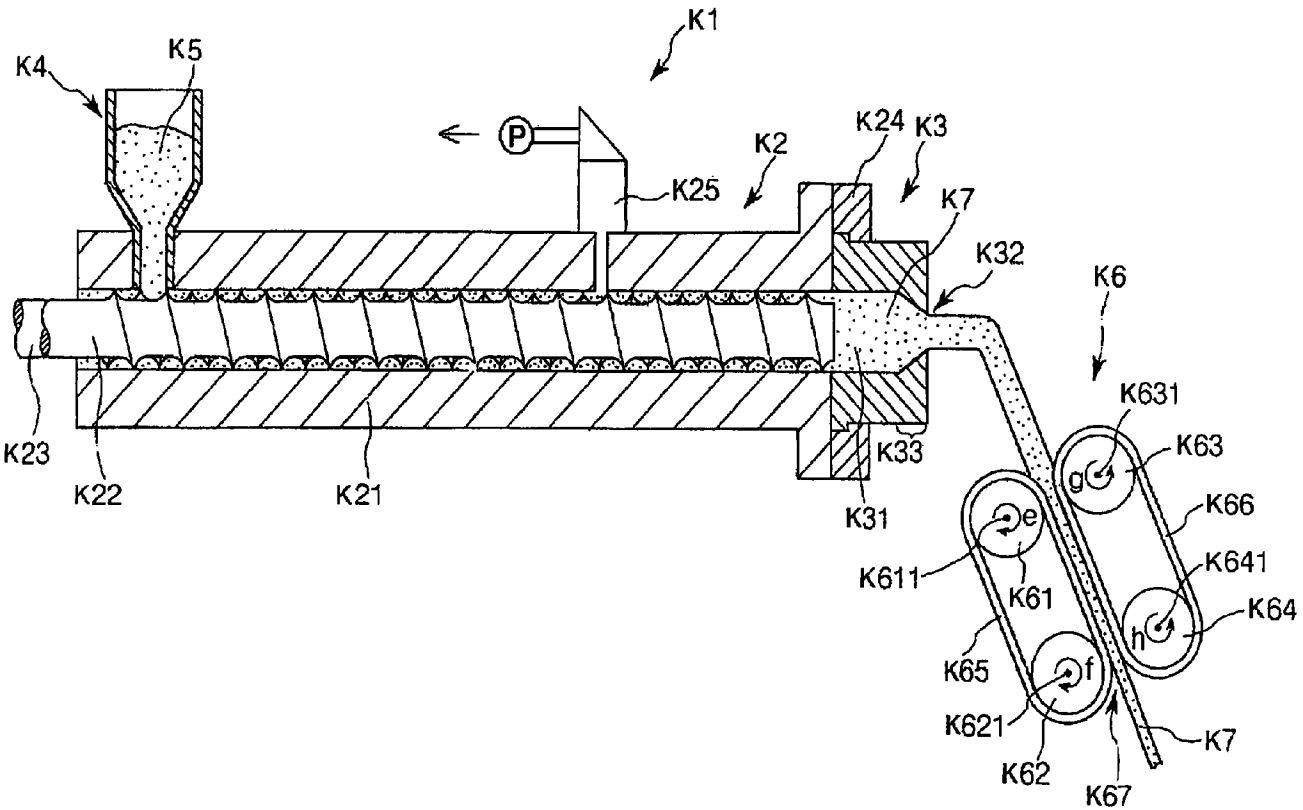
FIG. 1 is a vertical cross-sectional view which schematically shows one example of the structure of a kneading machine and a cooling machine for producing a kneaded material used for preparing a water-based emulsion from which toner particles used in a liquid developer according to the present invention are to be formed.

Hereinbelow, with reference to the accompanying drawings, preferred embodiments of a liquid developer according to the present invention will be described in details.

A liquid developer of the present invention includes an insulation liquid and toner particles dispersed in the insulation liquid.

<Insulation Liquid>

First, a description will be made with regard to the insulation liquid used in the liquid developer according to the present invention.

The insulation liquid of the present invention contains as its main component a glyceride of an unsaturated fatty acid, and further contains an oxidation polymerization accelerator for accelerating oxidation polymerization reaction of the glyceride during the fixing process of the toner particles. In this regard, it should be noted that in the specification and claims of this application the glyceride of the unsaturated fatty acid means an ester of an unsaturated fatty acid and a glycerin.

As stated in the above, the insulation liquid used in the conventional liquid developer is mainly composed of a petroleum-based carbon hydride. Therefore, in the conventional liquid developer, there is concern that the insulation liquid may give an adverse affect to environment if it flows out of an image forming apparatus.

In contrast, a glyceride of an unsaturated fatty acid (hereinafter, simply referred to "unsaturated fatty acid glyceride") is a substance which is harmless to environment. Therefore, it is possible to reduce an adverse affect to environment caused by volatilization of the insulation liquid when it is used during the fixing process or disposal of the liquid developer. As a result, it is possible to provide a liquid developer harmless to environment.

Examples of the unsaturated fatty acid which can constitute the unsaturated fatty acid glyceride of the present invention include monounsaturated fatty acids such as oleic acid and palmitoleic acid, polyunsaturated fatty acids such as linoleic acid, α-linolenic acid, γ-linolenic acid, arachidonic acid, docosahexaenoic acid (DHA) and eicosapentaenoic acid (EPA) and the like. These unsaturated fatty acids can be used singly or in combination of two or more of them.

Such unsaturated fatty acids can be obtained effectively from naturally derived oils such as vegetable oils, animal oils and the like. Examples of the vegetable oils include soybean oil, rape oil, linseed oil, safflower oil, cottonseed oil, and the like while examples of the animal oils include herring oil, sardine oil, and the like.

In this regard, it is to be noted that in this specification the term "an insulation liquid which contains as its major component an unsaturated fatty acid" indicates an insulation liquid in which the amount of the unsaturated fatty acid contained therein is 50 wt % or more, preferably 90 wt % or more, even more preferably 95 wt % or more, and most preferably 97 wt % or more.

The liquid developer of the present invention further contains in its insulation liquid an oxidation polymerization accelerator for accelerating oxidation polymerization reaction of the glyceride during the fixing process of the toner particles.

As described above, when a liquid developer is used, an insulation liquid is adhering to a surface of each toner particle at the fixing process of the toner particles. Accordingly, in the conventional liquid developer, there is a problem in that such an insulation liquid adhering to the surface of the particle lowers a fixing strength of the toner particle.

However, by using an insulation liquid which contains an unsaturated fatty acid glyceride and an oxidation polymerization accelerator (promoter) like the present invention, the unsaturated fatty acid glyceride adhering to each toner particle is cured through the oxidation polymerization reaction during the fixing process. As a result, it becomes possible to improve the fixing strength of the toner particles.

In other words, in the conventional liquid developer, an insulation liquid adhering to the toner particle causes the lowering of the fixing strength of the toner particles during the fixing process. On the other hand, the feature of the present invention resides in the point that the fixing strength of the toner particles is improved by curing the unsaturated fatty acid glyceride contained in the insulation liquid.

It is preferred that such an oxidation polymerization accelerator is of the type that promotes the oxidation polymerization reaction of the unsaturated fatty acid glyceride by supplying oxygen during the fixing process. This makes it possible to promote the oxidation polymerization reaction during the fixing process while preventing oxidation polymerization reaction from being caused during the storage or preservation thereof.

There is no specific limitation on the types of the oxidation polymerization accelerator if it can accelerate the oxidation polymerization reaction during the fixing process. Examples of such an oxidation polymerization accelerator include various metal salts of a fatty acid and the like. Such metal salts of the fatty acid can be used singly or in combination with two or more of them. This makes it possible to accelerate the oxidation polymerization reaction of the unsaturated fatty acid glyceride during the fixing process while maintaining the stability of the liquid developer during the storage thereof. Further, since metal salts of a fatty acid have higher dispersibility to the unsaturated fatty acid glyceride, it is possible to disperse the metal salts of the fatty acid into the unsaturated fatty acid glyceride homogeneously. With this result, it is possible to progress the oxidation polymerization reaction effectively as a whole during the fixing process.

Examples of such metal salts of a fatty acid include metal salts of a resin acid (e.g. a cobalt salt, a manganese salt and a lead salt thereof), metal salts of a linolenic acid (e.g. a cobalt salt, a manganese salt, and a lead salt thereof). metal salts of an octylic acid (e.g. a cobalt salt, a manganese salt, a lead salt, a zinc salt, and a calcium salt thereof), metal salts of a naphthenic acid (e.g. a zinc salt and a calcium salt thereof). These metal salts of a fatty acid may be used singly or in combination with two or more of them.

The oxidation polymerization accelerator may be contained in the insulation liquid with being encapsulated. By using such encapsulated oxidation polymerization accelerator, it is possible to prevent oxidation polymerization reaction from being caused during the storage or preservation of the liquid developer more reliably. Further, since the capsules of the oxidation polymerization accelerator are collapsed with a predetermined pressure applied at the fixing process, it is possible to progress the oxidation polymerization reaction of the unsaturated fatty acid glyceride reliably. Furthermore, since the unsaturated fatty acid glyceride is cured, it is possible to write letters or the like onto the fixed toner image with a ballpoint pen with a water-based ink.

Various methods can be used for encapsulating the oxidation polymerization accelerator. For example, the encapsulation of the oxidation polymerization accelerator may be carried out by allowing the oxidation polymerization accelerator to be adsorbed by porous bodies and then coating the porous bodies with polyether. Examples of such porous bodies include hydrophilic silica, hydrophilic alumina, hydrophilic titanium oxide and the like.

The amount of the oxidation polymerization accelerator contained in the insulation liquid is preferably in the range of 0.01 to 10 wt %, more preferably in the range of 0.05 to 5 wt %, and even more preferably in the range of 0.1 to 3 wt %. This makes it possible to progress the oxidation polymerization reaction of the unsaturated fatty acid glyceride during the fixing process more reliably while preventing oxidation polymerization reaction from being caused during the storage or preservation of the liquid developer sufficiently.

In this regard, it is to be noted that the liquid developer may further contain an antioxidizing agent. This makes it possible to prevent the oxidation polymerization reaction from being caused during the storage or preservation of the liquid developer more reliably.

Examples of such an antioxidizing agent include vitamin E such as tocopherol, d-tocopherol, d1-α-tocopherol, acetic acid-α-tocopherol, acetic acid d1-α-tocopherol, tocopherol acetate, and α-tocopherol, a vitamin C such as ascorbic acid, ascorbic acid salts (ascorbate), ascorbate stearic acid ester, dibutyl hydroxy toluene, butyl hydroxy anisole, green tea extract, green coffee bean extract, sesamol, sesaminol, and the like. These antioxidizing agents may be used singly or in combination with two or more of them.

Among these substances, when a vitamin E is used, it is possible to obtain the following effects. Namely, a vitamin E is a substance which is harmless to environment, and its oxidative product produced by oxidation thereof gives only small affects to the liquid developer, and thus it is possible to obtain a liquid developer which is more harmless to environment. Further, since a vitamin E is a substance having high dispersibility to the unsaturated fatty acid glyceride, it can be used as the antioxidizing agent preferably.

Furthermore, by using a vitamin E together with the unsaturated fatty acid glyceride described above, it is possible to further improve compatibility of a toner material with the insulation liquid, thereby enabling the storage stability of the liquid developer to be improved further.

Further, among the substances mentioned above, when a vitamin C is used, it is possible to obtain the following effects. Namely, as is the same with the vitamin E described above, a vitamin C is a substance which is harmless to environment, and its oxidative product produced by oxidation thereof gives only small affects to the liquid developer, and thus it is possible to obtain a liquid developer which is more harmless to environment. Further, since a vitamin C is a substance having a relatively low pyrolysis temperature, it can exhibit a function as the antioxidizing agent sufficiently during the storage or preservation of the liquid developer while the function as the antioxidizing agent is lowered during the fixing process so that the oxidation polymerization reaction of the unsaturated fatty acid glyceride by the oxidation polymerization accelerator is promoted.

It is preferred that the pyrolysis temperature of the antioxidizing agent is lower than the fixing temperature during the fixing process. This makes it possible to prevent oxidization of the unsaturated fatty acid glyceride during the storage or preservation of the liquid developer more reliably. Further, the antioxidizing agent contained in the insulation liquid adhering to the surfaces of the toner particles are thermally decomposed during the fixing process. As a result, since the effect of the antioxidizing agent is lowered, it is possible to promote the oxidation polymerization reaction of the unsaturated fatty acid glyceride by the oxidation polymerization accelerator.

The pyrolysis temperature of the antioxidizing agent is preferably equal to or lower than 200° C., and more preferably equal to or lower than 180° C. This makes it possible for the antioxidizing agent to exhibit its function sufficiently during the storage or preservation of the liquid developer. Further, it is also possible to promote the oxidation polymerization reaction of the unsaturated fatty acid glyceride by the oxidation polymerization accelerator since the function of the antioxidizing agent is appropriately lowered during the fixing process.

The amount of the antioxidizing agent contained in the insulation liquid is preferably in the range of 0.01 to 10 wt %, more preferably in the range of 0.1 to 5 wt %, and even more preferably in the range of 1 to 5 wt %. This makes it possible to prevent the oxidation polymerization reaction of the unsaturated fatty acid glyceride during the storage or preservation of the liquid developer more reliably.

The electric resistance of the insulation liquid at room temperature (20° C.) described above is preferably equal to or higher than $1\times10^{9}$ Ωcm, more preferably equal to or higher than $1\times10^{11}$ Ωcm, and even more preferably equal to or higher than $1\times10^{13}$ Ωcm.

Further, the dielectric constant of the insulation liquid is preferably equal to or lower than 3.5.

Furthermore, the iodine value of the insulation liquid is, but not limited thereto, preferably equal to or higher than 90, and more preferably in the range of 120 to 180. This makes it possible to improve the fixing strength of the toner particles when they are fixed onto a recording medium. Further, since compatibility of a toner material with the insulation liquid can be increased, it is possible to further improve the storage stability of the liquid developer.

It should be noted that the insulation liquid may contain other components in addition to the unsaturated fatty acid glyceride, the oxidation polymerization accelerator, and the antioxidizing agent, but the amount of the other components is preferably 20 wt % or less, and more preferably 10 wt % or less.

<Constituent Materials of Toner Particles>

Hereinbelow, a description will be made with regard to the constituent materials of the toner particles The toner particles (toner) which constitute the liquid developer according to the present invention contains at least a binder resin (resin material) and a coloring agent.

1. Resin (Binder Resin)

Toner particles contained in a liquid developer are constituted from a material which contains a resin (binder resin) as its main component.

In the present invention, there is no specific limitation on the kinds of a resin (binder resin) to be used. Examples of such a resin (binder resins) include styrene-based resins (homopolymers or copolymers containing styrene or a styrene substituent) such as polystyrene, poly-α-methylstyrene, chloropolystyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic ester copolymer, styrene-methacrylic ester copolymer, styrene-acrylic ester-methacrylic ester copolymer, styrene-α-methyl chloroacrylate copolymer, styrene-acrylonitrile-acrylic ester copolymer, and styrene-vinyl methyl ether copolymer, polyester-based resins, epoxy resins, urethane-modified epoxy resins, silicone-modified epoxy resins, vinyl chloride resins, rosin-modified maleic acid resins, phenyl resins, polyethylene-based resins, polypropylene, ionomer resins, polyurethane resins, silicone resins, ketone resins, ethylene-ethylacrylate copolymer, xylene reins, polyvinyl butyral resins, terpene reins, phenol resins, and aliphatic or alicyclic hydrocarbon resins. These binder resins can be used singly or in combination of two or more of them.

The softening point of the resin (resin material) is not particularly limited to any specific value, but it is preferably in the range of 50 to 130° C., more preferably in the range of 50 to 120° C., and even more preferably in the range of 60 to 115° C. In this specification, the term "softening point" means a temperature at which softening is begun under the conditions that a temperature raising speed is 5° C./mim and a diameter of a die hole is 1.0 mm in a high-floored flow tester (manufactured by Shimadzu Corporation).

2. Coloring Agent

The toner particles of the liquid developer also contain a coloring agent. As for a coloring agent, pigments, dyes or the like can be used. Examples of such pigments and dyes include Carbon Black, Spirit Black, Lamp Black (C.I. No. 77266), Magnetite, Titanium Black, Chrome Yellow, Cadmium Yellow, Mineral Fast Yellow, Navel Yellow, Naphthol Yellow S, Hansa Yellow G, Permanent Yellow NCG, Benzidine Yellow, Quinoline Yellow, Tartrazine Lake, Chrome Orange, Molybdenum Orange, Permanent Orange GTR, Pyrazolone Orange, Benzidine Orange G, Cadmium Red, Permanent Red 4R, Watching Red Calcium Salt, Eosine Lake, Brilliant Carmine 3B, Manganese Violet, Fast Violet B, Methyl Violet Lake, Prussian Blue, Cobalt Blue, Alkali Blue Lake, Victoria Blue Lake, Fast Sky Blue, Indanthrene Blue BC, Ultramarine Blue, Aniline Blue, Phthalocyanine Blue, Chalco Oil Blue, Chrome Green, Chromium Oxide, Pigment Green B, Malachite Green Lake, Phthalocyanine Green, Final Yellow Green G, Rhodamine 6G, Quinacridone, Rose Bengal (C.I. No. 45432), C.I. Direct Red 1, C.I. Direct Red 4, C.I. Acid Red 1, C.I. Basic Red 1, C.I. Mordant Red 30, C.I. Pigment Red 48:1, C.I. Pigment Red 57:1, C.I. Pigment Red 122, C.I. Pigment Red 184, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Pigment Blue 15:1, C.I.

Pigment Blue 15:3, C.I. Pigment Blue 5:1, C.I. Direct Green 6, C.I. Basic Green 4, C.I. Basic Green 6, C.I. Pigment Yellow 17, C.I. Pigment Yellow 93, C.I. Pigment Yellow 97, C.I. Pigment Yellow 12, C.I. Pigment Yellow 180, C.I. Pigment Yellow 162, and Nigrosine Dye (C.I. No. 50415B); metal oxides such as metal complex dyes, silica, aluminum oxide, magnetite, maghemite, various kinds of ferrites, cupric oxide, nickel oxide, zinc oxide, zirconium oxide, titanium oxide, magnesium oxide, and the like; and magnetic materials including magnetic metals such as Fe, Co, and Ni; and the like. These pigments and dyes can be used singly or in combination of two or more of them.

3. Other Components

In preparing the kneaded material, additional components other than the above components may be contained. Examples of such other components include a wax, a charge control agent, a magnetic powder, and the like.

Examples of such a wax include hydrocarbon wax such as ozokerite, ceresin, paraffin wax, micro wax, microcrystalline wax, petrolatum, Fischer-Tropsch wax, or the like; ester wax such as carnauba wax, rice wax, methyl laurate, methyl myristate, methyl palmitate, methyl stearate, butyl stearate, candelilla wax, cotton wax, Japan wax, beeswax, lanolin, montan wax, fatty ester, or the like; olefin wax such as polyethylene wax, polypropylene wax, oxidized polyethylene wax, oxidized polypropylene wax, or the like; amide wax such as 12-hydroxystearic acid amide, stearic acid amide, phthalic anhydride imide, or the like; ketone wax such as laurone, stearone, or the like; ether wax; and the like. These waxes can be used singly or in combination of two or more.

Examples of the charge control agent include a metallic salt of benzoic acid, a metallic salt of salicylic acid, a metallic salt of alkylsalicylic acid, a metallic salt of catechol, a metal-containing bisazo dye, a nigrosine dye, tetraphenyl borate derivatives, a quaternary ammonium salt, an alkylpyridinium salt, chlorinated polyester, nitrohumic acid, and the like.

Further, examples of the magnetic powder include a powder made of a magnetic material containing a metal oxide such as magnetite, maghemite, various kinds of ferrites, cupric oxide, nickel oxide, zinc oxide, zirconium oxide, titanium oxide, magnesium oxide, or the like, and/or magnetic metal such as Fe, Co or Ni.

Further, the constituent material of the kneaded material may further contain zinc stearate, zinc oxide, cerium oxide, silica, titanium oxide, iron oxide, aliphatic acid, or aliphatic metal salt, or the like in addition to the components described above.

The average particle size (diameter) of the toner particles constituted from the above described materials is preferably in the range of 0.1 to 5 μm, more preferably in the range of 0.1 to 4 μm. even more preferably in the range of 0.5 to 3 μm. If the average particle size of the toner particles is within the above range, variations in properties of the toner particles can be made sufficiently small. Consequently, it is possible to make resolution of a toner image formed from the liquid developer (liquid toner) sufficiently high so that the liquid developer can have high reliability as a whole.

Further, it is preferred that a standard deviation of particle size among the toner particles which constitute the liquid developer is 1.0 μm or less, more preferably in the range of 0.1 to 1.0 μm, and even more preferably in the range of 0.1 to 0.8 μm. When the standard deviation of particle size lies within the above range, variations in properties of the toner particles can be made especially small, thereby further improving the reliability of the liquid developer as a whole.

Furthermore, it is also preferred that an average roundness R represented by the following formula (I) is 0.85 or higher, more preferably in the range of 0.90 to 0.99, and even more preferably 0.92 to 0.99.

$$R=L_0/L_1 \quad \text{(I)}$$

wherein $L_1$ (μm) represents the circumference of projected image of a toner particle that is a subject of measurement, and $L_0$ (μm) represents the circumference of a perfect circle (a geometrically perfect circle) having the same area as that of the projected image of the toner particle that is a subject of measurement.

When the average roundness R of the toner particles is within the above range, the transfer efficiency and the mechanical strength of the toner particles can be made excellent while the particle size of the toner particles can be made sufficiently small.

In this case, it is preferred that a standard deviation of the average roundness among the toner particles is 0.15 or less, more preferably in the range of 0.001 to 0.10, even more preferably 0.001 to 0.05. When the standard deviation of average roundness among the toner particles lies within the above range, variations in electrification properties, fixing properties, etc are especially small, thereby further improving the reliability of the liquid developer as a whole.

Next, with reference to the accompanying drawings, a description will be made with regard to one example of a method for producing a liquid developer according to the present invention.

Figure 2:
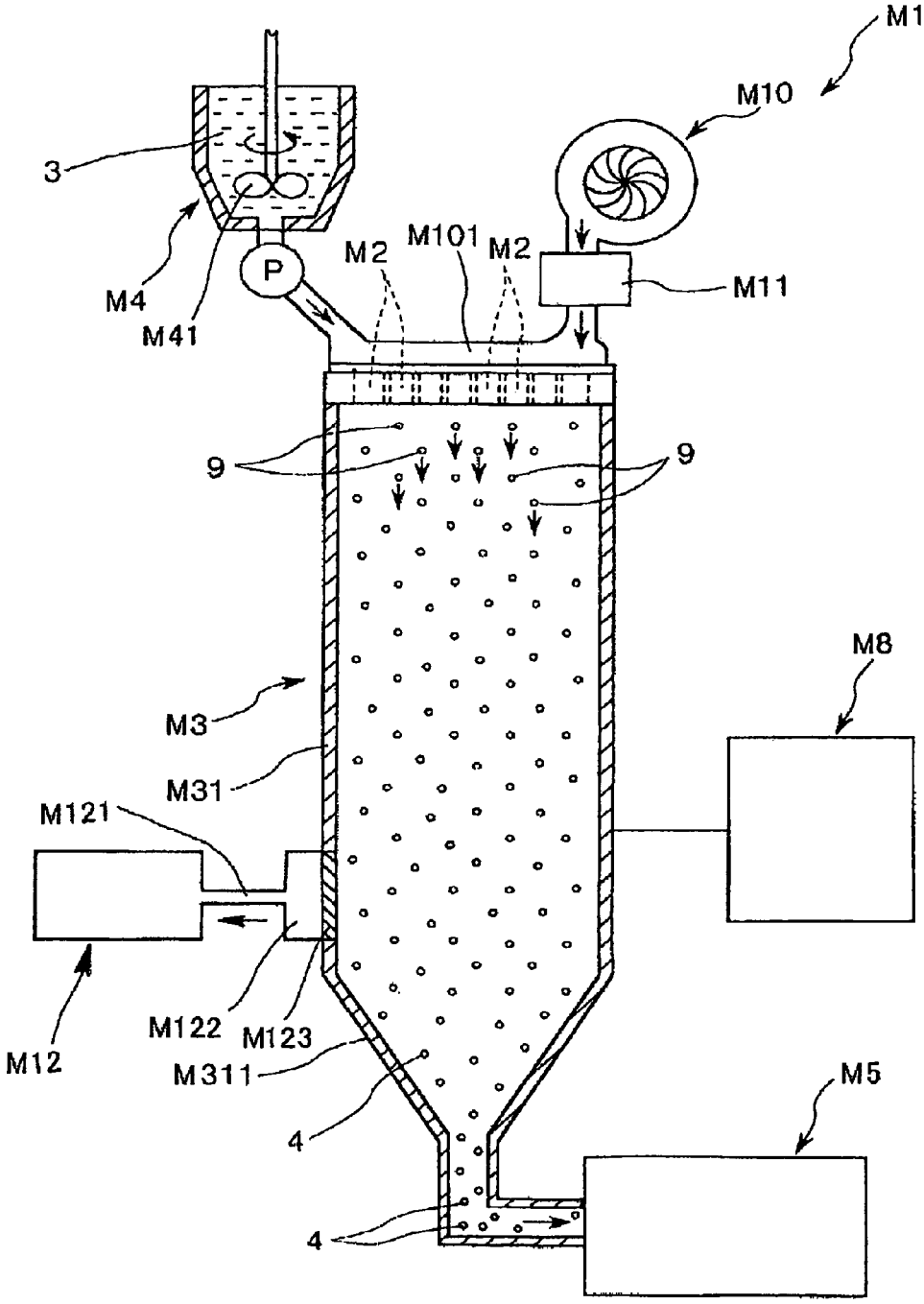
FIG. 2 is a vertical cross-sectional view which schematically shows one example of a dry fine particle producing apparatus (an apparatus for producing toner particles) used in producing a liquid developer according to the present invention.
Figure 3:
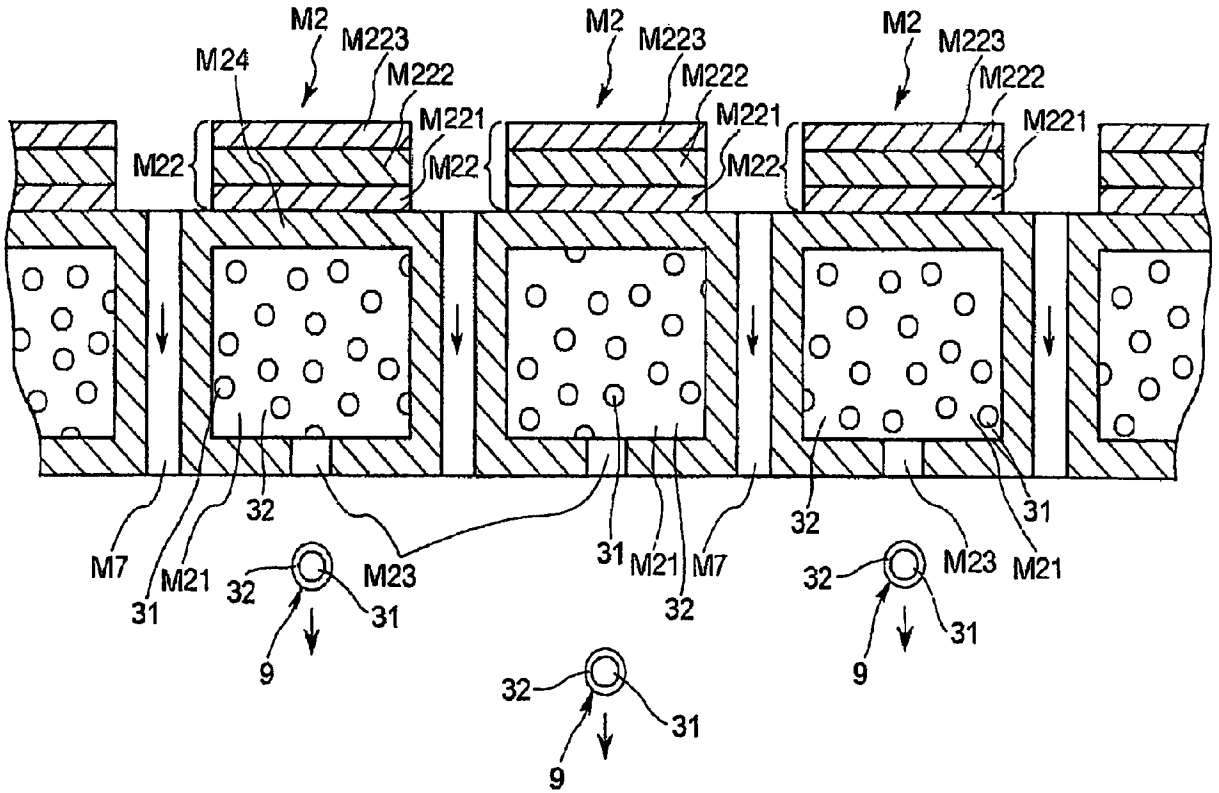
FIG. 3 is an enlarged sectional view of a head portion of the dry fine particle producing apparatus shown in FIG. 2.

FIG. 1 is a vertical cross-sectional view which schematically shows one example of the structure of a kneading machine and a cooling machine for producing a kneaded material used for preparing a water-based emulsion from which toner particles used in a liquid developer according to the present invention are to be formed, FIG. 2 is a vertical cross-sectional view which schematically shows one example of a dry fine particle producing apparatus (an apparatus for producing toner particles) used in producing a liquid developer according to the present invention, and FIG. 3 is an enlarged sectional view of a head portion of the dry fine particle producing apparatus shown in FIG. 2. In the following description, the left side in FIG. 1 is referred to as "base side" and the right side in FIG. 1 is referred to as "top side".

The liquid developer of the present invention may be produced using any various methods, but an embodiment of a liquid developer according to the present invention described below is produced by a liquid toner producing method which comprises a dispersion liquid preparing step for obtaining a dispersion liquid which contains a dispersion medium and a dispersoid constituted from the toner material as described above and dispersed in the dispersion medium, a dispersion medium removal step for removing the dispersion medium to obtain dry fine particles, and a dispersion step for dispersing the dry fine particles in an insulation liquid.

The following embodiment is directed to the case where a water-based dispersion liquid in which a dispersoid is dispersed in a water-based dispersion medium constituted from a water-based liquid. By using such a water-based dispersion liquid, it is possible to provide a liquid developer which is harmless to environment.

The water-based dispersion liquid may be prepared by any various methods, but in the following embodiment, a water-based dispersion liquid prepared using a kneaded material containing a coloring agent and a resin material.

In this regard, it is to be noted that constituent materials (components) of the kneaded material may contain a component that can be used as a solvent such as an inorganic solvent or organic solvent in addition to the components that constitute toner particles as described above. This makes it possible to improve efficiency of kneading, thereby enabling to easily obtain a kneaded material in which the components are homogeneously mixed or kneaded with each other.

<Kneaded Material>

Hereinbelow, a description will be made with regard to one example of a method for obtaining a kneaded material K7 by kneading a material K5 which is a toner material containing the above-mentioned components.

The kneaded material K7 can be manufactured using a kneading machine as shown in FIG. 1.

<Kneading Step>

The material K5 to be kneaded contains the components as described above. Since the material K5 contains a coloring agent, air contained in the coloring agent is likely to be included in the material K5. This means that there is a possibility that air bubble may enter the inside of the toner particle. However, since the material K5 is subjected to the kneading process in this step, it is possible to eliminate air contained in the material K5 efficiently, and therefore it is possible to prevent air bubble from entering the inside of the toner particle effectively, that is, prevent air bubble from remaining inside the toner particle effectively. Further, it is preferred that the material K5 to be kneaded is prepared in advance by mixing the above-mentioned various components.

In this embodiment, a biaxial kneader-extruder is used as the kneading machine, a detail of which will be described below.

The kneading machine K1 includes a process section K2 which kneads the material K5 while conveying it, a head section K3 which extrudes a kneaded material K7 so that an extruded kneaded material can have a prescribed cross-sectional shape, and a feeder K4 which supplies the material K5 into the process section K2.

The process section K2 has a barrel K21, screws K22 and K23 inserted into the barrel K21, and a fixing member K24 for fixing the head section K3 to the front portion of the barrel K21, fixing the head section K3 to the front portion of the barrel K21.

In the process section K2, a shearing force is applied to the material K5 supplied from the feeder K4 by the rotation of the screws K22 and K23 so that a homogeneous kneaded material K7 is obtained.

In this embodiment, it is preferred that the total length of the process section K2 is in the range of 50 to 300 cm, and more preferably in the range of 100 to 250 cm. If the total length of the process section K2 is less than the above lower limit value, there is a case that it is difficult to mix and knead the components in the material K5 homogeneously. On the other hand, if the total length of the process section K2 exceeds the above upper limit value, there is a case that thermal modification of the material K5 is likely to occur depending on the temperature inside the process section K2, the number of revolutions of the screws K22 and K23, or the like, thus leading to a possibility that it becomes difficult to control the physical properties of a finally obtained liquid developer (that is, a resultant liquid toner) sufficiently.

In this connection, the temperature of the material (material temperature) during the kneading step is preferably in the range of 80 to 260° C., and more preferably in the range of 90 to 230° C. though it varies depending on the composition of the material K5 and the like. In this regard, it is to be noted that the temperature of the material inside the process section K2 may be constant throughout the process section K2 or different depending on positions inside the process section K2. For example, the process section K2 may include a first region in which an internal temperature is set to be relatively low and a second region which is provided at the base side of the first region and in which an internal temperature is set to be higher than the internal temperature of the first region.

Moreover, it is preferred that the residence time of the material K5 in the process section K2, that is the time required for the material K5 to pass through the process section K2, is 0.5 to 12 minutes, and more preferably 1 to 7 minutes. If the residence time of the material K5 in the process section K2 is less than the above lower limit value, there is a possibility that it is difficult to mix the components in the material K5 homogeneously. On the other hand, if the residence time of the material K5 in the process section K2 exceeds the above upper limit value, there is a possibility that production efficiency is lowered, and thermal modification of the material K5 is likely to occur depending on the temperature inside the process section 2 or the number of revolutions of the screws K22 and K23 or the like, thus resulting in a case that it is difficult to control the physical properties of a finally obtained liquid developer (that is, a resultant liquid toner) satisfactorily.

Although the number of revolutions of the screws K22 and K23 varies depending on the compositions of the binder resin or the like, it is preferably in the range of 50 to 600 rpm. If the number of revolutions of the screws K22 and K23 is less than the above lower limit value, there is a case that it is difficult to mix the components of the material K5 homogeneously. On the other hand, if the number of revolutions of the screws K22 and K23 exceeds the above upper limit value, there is a case that molecular chains of the resin are cut due to a shearing force, thus resulting in the deterioration of the characteristics of the resin.

In the kneading machine K1 used in this embodiment, the inside of the process section K2 is connected to a pump P through a duct K25. This makes it possible to deaerate the inside of the process section K2, thereby enabling to prevent the pressure inside the process section K2 from raising due to heated-up or heat generation of the material K5 (kneaded material K7). As a result, the kneading step can be carried out safely and effectively. Further, since it is possible to prevent air bubble (in particular, relatively large air bubble) from being contained in the kneaded material K7 effectively, a liquid developer (that is, a liquid toner) having excellent properties can be obtained.

<Extrusion Process>

The kneaded material K7 which has been kneaded in the process section K2 is extruded to the outside of the kneading machine K1 via the head section K3 by the rotation of the screws K22 and K23.

The head section K3 has an internal space K31 to which the kneaded material K7 is sent from the process section K2, and an extrusion port K32 through which the kneaded material K7 is extruded.

In this connection, it is preferred that the temperature (temperature at least in the vicinity of the extrusion port K32) of the kneaded material K7 in the internal space K31 is higher than the softening point of the resin materials contained in the material K5. When the temperature of the kneaded material K7 is such a temperature, it is possible to obtain toner particles in which the components thereof are homogeneously mixed, thereby enabling to make variations in their properties such as chargeable characteristics, fixing properties, and the like especially small.

The concrete temperature of the kneaded material K7 inside the internal space K31 (that is, the temperature of the kneaded material K7 at least in the vicinity of the extrusion port K32) is not limited to a specific temperature, but is preferably in the range of 80 to 150° C., and more preferably in the range of 90 to 140° C. In the case where the temperature of the kneaded material K7 in the internal space K31 is within the above range, the kneaded material K7 is not solidified inside the internal space K31 so that it can be extruded from the extrusion port K32 easily.

The internal space K31 having a structure as shown in FIG. 1 includes a cross sectional area reduced portion K33 in which a cross sectional area thereof is gradually reduced toward the extrusion port K32. Due to the cross sectional area reduced portion K33, the extrusion amount of the kneaded material K7 which is to be extruded from the extrusion port 32K becomes stable, and the cooling rate of the kneaded material K7 in a cooling process which will be described later also becomes stable. As a result of this, variations in properties of the obtained toner particles can be made small, whereby enabling to produce a liquid developer (that is, a liquid toner) having excellent properties.

<Cooling Process>

The kneaded material K7 in a softened state extruded from the extrusion port K32 of the head section K3 is cooled by a cooler K6 and thereby it is solidified.

The cooler K6 has rolls K61, K62, K63 and K64, and belts K65 and K66.

The belt K65 is wound around the rolls K61 and K62, and similarly, the belt K66 is wound around the rolls K63 and K64.

The rolls K61, K62, K63 and K64 rotate in directions shown by the arrows e, f, g and h in the drawing about rotary shafts K611, K621, K631 and K641, respectively. With this arrangement, the kneaded material K7 extruded from the extrusion port K32 of the kneading machine K1 is introduced into the space between the belts K65 and K66. The kneaded material K7 is then cooled while being molded into a plate-like object with a nearly uniform thickness, and is ejected from an ejection part K67. The belts K65 and K66 are cooled by, for example, an air cooling or water cooling method. By using such a belt type cooler, it is possible to extend a contact time between the kneaded material extruded from the kneading machine and the cooling members (belts), thereby enabling the cooling efficiency for the kneaded material to be especially excellent.

Now, during the kneading process, since the material K5 is subjected to a shearing force, phase separation (in particular, macro-phase separation) can be prevented. However, since the kneaded material K7 which has been discharged out of the kneading process is free from the shearing force, there is a possibility that phase separation (in particular, macro-phase separation) will occur again if such a kneaded material is being left for a long period of time. Accordingly, it is preferable to cool the thus obtained kneaded material K7 as quickly as possible. More specifically, it is preferred that the cooling rate (for example, the cooling rate when the kneaded material K7 is cooled down to about 60° C.) of the kneaded material K7 is faster than 3° C./sec, and more preferably in the range of 5 to 100° C./sec. Moreover, the time between the completion of the kneading process (at which the kneaded material is free from the shearing force) and the completion of the cooling process (time required to lower the temperature of the kneaded material K7 to 60° C. or lower, for example) is preferably 20 seconds or less, and more preferably in the range of 3 to 12 seconds.

In the above embodiment, a description has been made in terms of an example using a continuous biaxial kneader-extruder as the kneading machine, but the kneading machine used for kneading the material is not limited to this type. For kneading the material, it is possible to use various kinds of kneading machines, for example, a kneader, a batch type triaxial roll, a continuous biaxial roll, a wheel mixer, a blade mixer, or the like.

Further, although in the embodiment shown in the drawing the kneading machine is of the type that has two screws. the number of screws may be one or three or more. Further, the kneading machine may have a disc section (kneading disc section).

Furthermore, in the embodiment described above, one kneading machine is used for kneading the material, but kneading may be carried out by using two kneading machines. In this case, the heating temperature of the material and the rotational speed of the screws of one kneading machine may be different from those of the other kneading machine.

Moreover, in the above embodiment, the belt type cooler is used, but a roll type (cooling roll type) cooler may be used. Furthermore, cooling of the kneaded material extruded from the extrusion port K32 of the kneading machine is not limited to the way using the cooler described above, and it may be carried out by air cooling, for example.

<Grinding Process>

Next, the kneaded material K7 obtained through the cooling process described above is ground. By grinding the kneaded material K7, it is possible to obtain a water-based emulsion (described later) in which a fine dispersants is dispersed relatively easily. As a result, it becomes possible to make the size of the toner particles smaller in a liquid developer finally obtained, and such a liquid developer can be preferably used in forming a high resolution image.

The method of grinding is not particularly limited. For example, such grinding may be carried out by employing various kinds of grinding machines or crushing machines such as a ball mill, a vibration mill, a jet mill, a pin mill, or the like.

The grinding process may be carried out by dividing it into a plurality of stages (for example, two stages of coarse and fine grinding processes). Further, after the grinding process, other treatment such as classification treatment may be carried out as needed. Such classification treatment may be carried out using a sieve or an air flow type classifier or the like.

By subjecting the material K5 to the kneading process as described above, it is possible to eliminate air contained in the material K5 effectively. In other words, the kneaded material K7 obtained through such a kneading process does not contain air (air bubble) in the inside thereof. By using such kneaded material K7, it is possible to prevent generation of toner particles of irregular shape (such as void particles, defect particles, fused particles, and the like) effectively. As a result, in a liquid developer finally obtained, it is possible to prevent occurrence of a problem such as lowered transfer property and cleaning property which are caused by such toner particles having irregular shape.

In the present invention, a water-based emulsion is prepared using the kneaded material described above.

By using the kneaded material K7 in preparing the water-based emulsion, the following effects can be obtained. Namely, even in the case where a constituent material of toner particles contains components which are difficult to be dispersed in a dispersion medium or difficult to be mutually soluble to each other, these components are mutually soluble to each other satisfactorily and finely dispersed in an obtained kneaded material by way of the kneading step described above. In particular, most of pigments (coloring agent) have poor dispersibility to a liquid used as a solvent. However, in this embodiment, because the kneading step has been carried out before the kneaded material is dispersed into a solvent, the outer periphery of each particle of a pigment is coated with a resin component effectively. Therefore, dispersibility of the pigment to the solvent is improved (particularly, the pigment can be finely dispersed in the solvent), color development of a finally obtained liquid developer becomes excellent. For these reasons, even in the case where a constituent material of toner particles contains a component having poor dispersibility to a dispersion medium of a water base-emulsion (water-based solvent) which will be described later (hereinafter, this component will be referred to as "poor dispersibility component") or a component having poor solubility to a solvent contained in a dispersion medium of a water-based emulsion (hereinafter, this component will be referred to as "poor solubility component"). it is possible to make dispersibility of a dispersoid in a water-based emulsion more excellent. Further, in a water-based suspension 3 (droplets 9), dispersibility of a dispersoid 31 becomes excellent. With these results, in a finally obtained liquid developer, variations in compositions and properties of respective toner particles can be made small, and therefore the liquid developer can have excellent properties as a whole.

On the other hand, in the case where a material which has not been kneaded is used in preparing a water-based emulsion, a poor dispersibility component and/or a poor solubility component are aggregated and then the aggregates thereof settle down in a water-based emulsion or a water-based suspension described later. As a result, a dispersoid comprised of relatively large particles which are mainly constituted from the poor dispersibility component and/or poor solubility component and which have not been sufficiently mixed with other components exist in the water based-emulsion (and the water based suspension). That is, a dispersoid comprised of large particles which are mainly constituted from the poor dispersibility component and/or poor solubility component and a dispersoid comprised of particles constituted from components other than the poor dispersibility component or poor solubility component exist in a water-based emulsion and/or a water-based suspension in a mixed state. Accordingly, dry fine particles (that is, toner particles) obtained in the water-based dispersion medium removal step described later are apt to have large variations in compositions, size and shape of the respective toner particles. As a result, properties of a liquid developer obtained are lowered as a whole.

Further, in the case where particles obtained by grinding the kneaded material are used as toner particles as they are without being used in preparing a water-based emulsion as described later, there is a limit on raising homogeneity (uniformity) of the components in the toner particles. Further, according to this method, it is particularly difficult to disperse or finely disperse a pigment which is generally in the form of relatively ridged aggregates (which is likely to be in the form of ridged aggregates).

In contrast, according to the present invention, since the kneaded material described above is used in preparing a water-based emulsion, it is possible to obtain toner particles in which the respective components are dispersed (finely dispersed) or mutually dissolved sufficiently homogeneously.

Further, in the water-based emulsion used in the present invention, a dispersoid is in a liquid sate (that is, a dispersoid has fluidity so that it can be deformed relatively easily), there is a tendency that each dispersoid is formed into a shape having a relatively high roundness (sphericity) due to its surface tension. Accordingly, in a suspension (water-based suspension) prepared using the water-based emulsion, there is also a tendency that each dispersoid is formed into a shape having a relatively high roundness (sphericity). Further, in the emulsion containing a dispersoid in a liquid state (that is, a dispersoid having fluidity so that it can be deformed relatively easily), it is possible to raise uniformity in the size of the dispersoid relatively easily by stirring the emulsion. In contrast, in the case where resin particles which are prepared without the water-based emulsion process are used in a suspension which is used for producing dry particles described later, a dispersoid contained in the suspension is likely to have low roundness, so that variations in the shape or particle size (diameter) of the respective particles become larger. In this connection, in order to suppress such variations in their shape, it may be conceived that a heat spheronization treatment is carried out when dry fine particles are being formed or after dry fine particles have been formed. However, in such a case (particularly, when such a heat spheronization treatment is carried out when dry fine particles are being formed), it is difficult to make the variations in shapes of the obtained particles sufficiently small unless otherwise conditions for the heat spheronization treatment are set to be relatively severe. Further, such severe conditions for the heat spheronization treatment in turn involves such problems in that deterioration of the constituent material of the dry fine particles is likely to occur and a mutually dissolved state and a finely dispersed state of the components in the respective dry fine particles are likely to occur, and thereby it becomes difficult for a finally obtained liquid developer to exhibit sufficient properties.

<Water-based Emulsion Preparing Step>

Next, by using the kneaded material K7, a water-based emulsion comprised of a water-based dispersion medium constituted from a water-based solvent in which a dispersoid constituted from a toner material is dispersed is prepared (water-based emulsion preparing step).

The method for preparing the water-based emulsion is not particularly limited, but in the present embodiment, a water-based emulsion is prepared by obtaining a solution in which at least a part of the kneaded material K7 is dissolved, and then by dispersing such a solution into a water-based solvent. In this connection, it should be noted that in this specification the term "emulsion" means a dispersion liquid comprised of a liquid state dispersion medium and a liquid state dispersoid (dispersion particles) dispersed in the dispersion medium, and the term "emulsion" means a suspension liquid (including suspension colloid). Further, in the case where a liquid state dispersoid and a solid state dispersoid exist in a dispersion liquid, the term "emulsion" means a dispersion liquid in which the total volume of the liquid state dispersoid is larger than the total volume of the solid state dispersoid, while the term "suspension" means a dispersion liquid in which the total volume of the solid state dispersoid is larger than the total volume of the liquid state dispersoid.

Hereinbelow, a description will be made with regard to the method for preparing the water-based emulsion.

<Preparation of Kneaded Material Solution>

In the present embodiment, a kneaded material solution (a solution of the kneaded material) in which at least a part of the kneaded material is dissolved is obtained.

The solution is prepared by mixing the kneaded material with a solvent in which at least a part of the kneaded material can be dissolved.

As for the solvent used for preparing the solution, various solvents can be used so long as at least a part of the kneaded material can be dissolved thereinto, but normally, solvents which have low mutual solubility to a water-based liquid described later (that is, a water-based liquid used for preparing the water-based emulsion) are used. For example, a liquid having a solubility of 10 g or less with respect to 100 g of a water-based liquid at a temperature of 25° C. is used.

Examples of such solvents include inorganic solvents such as carbon disulfide, and carbon tetrachloride, and organic solvents such as ketone-based solvents (e.g., methyl ethyl ketone (MEK), methyl isopropyl ketone (MIPK), and 2-heptanone). alcohol-based solvents (e.g., pentanol, n-hexanol, 1-octanol, and 2-octanol), ether-based solvents (e.g., diethyl ether, and anisole), aliphatic hydrocarbon-based solvents (e.g., hexane, pentane, heptane, cyclohexane, octane, and isoprene), aromatic hydrocarbon-based solvents (e.g., toluene, xylene, benzene, ethyl benzene, and naphthalene), aromatic heterocyclic compound-based solvents (e.g., furan, and thiophene), halide-based solvents (e.g., chloroform), ester-based solvents (e.g., ethyl acetate, isopropyl acetate, isobutyl acetate, and ethyl acrylate), nitrile-based solvents (e.g., acrylonitrile), and nitro-based solvents (e.g., nitromethane and nitroethane). These materials can be used singly or in combination of two or more of them.

The amount of the solvent contained in the solution is not limited to any specific value, but is preferably in the range of 5 to 75 wt %, more preferably in the range of 10 to 70 wt %, and even more preferably in the range of 15 to 65 wt %. If the amount of the solvent contained in the solution is less than the above lower limit value, there is a possibility that it is difficult to dissolve the kneaded material sufficiently depending on the solubility of the kneaded material to the solvent. On the other hand, if the amount of the solvent exceeds the above upper limit value, a time required for removing the solvent in the subsequent step becomes long, the productivity of the liquid development is lowered. Further, if the amount of the solvent is too much, there is a possibility that the components which were sufficiently and homogeneously mixed to each other are phase-separated, and thereby making it difficult to make variations in the properties of the toner particles of a finally obtained liquid developer sufficiently small.

In this regard, it is to be noted that it is sufficient that at least a part of the components which constitutes the kneaded material is dissolved (including a swelling state), and therefore components which were not dissolved may exist in the solution.

<Preparation of Water-based Emulsion>

Next, a water-based emulsion is obtained by mixing the above mentioned solution with a water-based liquid. Normally, in the thus obtained water-based emulsion, a dispersoid which contains the solvent and the constituent material of the kneaded material are dispersed in the water-based dispersion medium formed from the water-based liquid.

In the present invention, the term "water-based liquid" means a liquid containing at least water ($H_2O$), and preferably it is constituted from water. The water content in the water-based liquid is preferably 50 wt % or higher, more preferably 80 wt % or higher, and still more preferably 90 wt % or higher.

In this regard, the water-based liquid may contain additional components other than water. For example, the water-based liquid may contain an additional component which has a good compatibility with water (e.g. a substance having a solubility of 30 g or more with respect to 100 g of water at 25° C.).

Examples of the such a component include alcohol-based solvents such as methanol, ethanol, propanol, and the like, ether-based solvents such as 1,4-dioxane, tetrahydrofuran (THF), and the like, aromatic heterocyclic compound-based solvents such as pyridine, pyrazine, pyrrole, and the like, amide-based solvents such as N,N-dimethylformamide (DMF), N,N-dimethylacetamide (DMA), and the like, nitrile-based solvents such as acetonitrile and the like, and aldehyde-based solvents such as acetaldehyde, and the like.

Further, in preparing the water-based emulsion, a dispersant or the like may be used for the purpose of improving the dispersibility of the dispersant. Examples of such a dispersant include: inorganic dispersants such as viscosity mineral, silica, tricalcium phosphate, and the like; nonionic organic dispersants such as polyvinyl alcohol, carboxymethyl cellulose, polyethylene glycol, and the like; anionic organic dispersants such as tristearic acid metal salts (e.g., aluminum salts), distearic acid metal salts (e.g., aluminum salts and barium salts), stearic acid metal salts (e.g., calcium salts, lead salts, and zinc salts), linolenic acid metal salts (e.g., cobalt salts, manganese salts, lead salts, and zinc salts), octanoic acid metal salts (e.g., aluminum salts, calcium salts, and cobalt salts), oleic acid metal salts (e.g., calcium salts and cobalt salts), palmitic acid metal salts (e.g., zinc salts), dodecylbenzenesulfonic acid metal salts (e.g., sodium salts), naphthenic acid metal salts (e.g., calcium salts, cobalt salts, manganese salts, lead salts, and zinc salts), resin acid metal salts (e.g., calcium salts, cobalt salts, manganese salts, lead salts, and zinc salts), polyacrylic acid metal salts (e.g., sodium salts), polymethacrylic acid metal salts (e.g., sodium salts), polymaleic acid metal salts (e.g., sodium salts), metal salts of acrylic acid-maleic acid copolymers (e.g., sodium salts), polystyrenesulfonic acid metal salts (e.g., sodium salts); and cationic organic dispersants such as quaternary ammonium salts; and the like. By using the dispersant as described above in preparing the water-based emulsion, it is possible to Improve the dispersibility of the dispersant. Further, it is also possible to make variations in shape and size of the dispersant in the water-based emulsion particularly small relatively easily, and also possible to make the shape of each dispersant roughly spherical shape. With these results, it is possible to obtain a liquid developer which is comprised of toner particles each formed into a roughly spherical shape and having uniform shape and size.

It is preferred that the solution is mixed with the water-based liquid while at least one of the solution or the water-based liquid is being stirred. This makes it possible to obtain an emulsion (a water-based emulsion) in which a dispersoid having small variations in its size and shape is homogeneously dispersed easily and reliably.

Examples of methods for mixing the solution and the water-based liquid include a method in which the solution is added (for example, dropped) into the water-based liquid contained in a container, a method in which the water-based liquid is added (for example, dropped) into the solution contained in a container, and the like. In these methods, the water-based material or the solution which is contained in a container is preferably being stirred.

The amount of the dispersoid in the water-based emulsion is not particularly limited, but preferably in the range of 5 to 55 wt %, and more preferably in the range of 10 to 50 wt %. This makes it possible to prevent bonding or aggregation of particles of the dispersoid more reliably, thereby enabling to make productivity of the toner particles (liquid developer) particularly superior.

The average diameter of the dispersant in the water-based emulsion is not particularly limited, but preferably in the range of 0.01 to 5 μm, and more preferably in the range of 0.1 to 3 μm. This makes it possible to prevent bonding or aggregation of particles of the dispersoid in the water-based emulsion more reliably, thereby enabling to make the size of the toner particles finally obtained optimum. In this regard, it is to be noted that the term "average diameter" means an average diameter of particles each having the reference volume.

Further, although the above description was made with regard to the case that the components of the kneaded material are contained in the dispersoid in the water-based emulsion, a part of the components of the kneaded material may be contained in the dispersion medium.

Furthermore, the water-based emulsion may contain additional components other than the above-mentioned components. Examples of such additional components include a charge controlling agent, magnetic powder and the like.

Example of the charge controlling agent include metal salts of benzoic acid, metal salts of salicylic acid, metal salts of alkyl salicylic acid, metal salts of catechol, metal-containing bisazo dyes, nigrosine dyes, tetraphenylborate derivatives, quaternary ammonium salts, alkyl pyridinium salts, chlorinated polyesters, nitrohumic acid, and the like.

Examples of the magnetic powders include powders of metal oxides such as magnetite, maghemite, various ferrites, cupric oxide, nickel oxide, zinc oxide, zirconium oxide, titanium oxide, magnesium oxide, and the like, and powders of magnetic materials containing magnetic metals such as Fe, Co, and Ni.

The water-based emulsion may further contain, for example, zinc stearate, zinc oxide, or cerium oxide, in addition to the above-mentioned materials.

<Water-based Suspension Preparing Step>

The thus obtained water-based emulsion may be brought to the water-based dispersion medium removal step described below as it in. However, in the present embodiment, a water-based suspension 3 comprised of a dispersion medium (water-based dispersion medium) and a solid state dispersoid 31 dispersed in the dispersion medium is obtained based on the water-based emulsion (in which the liquid state dispersant is dispersed in the water-based dispersion medium), and the thus obtained water-based suspension is used in the water-based dispersion medium removal step.

Hereinbelow, a detailed description will be made with regard to a method for preparing the water-based suspension 3.

The water-based suspension 3 can be prepared by removing the solvent which constitutes the dispersant from the water-based emulsion.

The removal of the solvent can be carried out, for example, by heating or warming the water-based emulsion or placing it in an atmosphere under reduced pressure. However, it is preferred that the water-based emulsion is heated under reduced pressure. This makes it possible to obtain a water-based suspension 3 containing a dispersoid 31 having particularly small variations in size and shape thereof relatively easily. Further, by removing the solvent as described above, it is possible to carry out a deaerating treatment in addition to the removal of the solvent. By the deaerating treatment, it is possible to reduce the amount of the dissolved air in the water-based suspension 3, and therefore when the dispersion medium 32 is removed from the droplets 9 of the water-based suspension 3 in the water-based dispersion medium removal section M3 of the dry fine particle producing apparatus M1, it is possible to prevent generation of air bubble in the water-based suspension 3 in a effective manner. As a result, it is possible to prevent toner particles having irregular shapes (such as void particles and defect particles) from entering (or being mixed into) a finally obtained liquid developer effectively.

When the water-based emulsion is heated (or warmed), the heating temperature is preferably in the range of 30 to 110° C., and more preferably in the range of 40 to 100° C. If the heating temperature is set to a value within the above range, it is possible to remove the solvent immediately while preventing generation of a dispersoid 31 having irregular shapes effectively (that is, preventing rapid vaporization (boiling) of a solvent from the inside of the dispersoid of the water-based emulsion).

Further, when the water-based emulsion is placed in an atmosphere under reduced pressure, the pressure of the atmosphere in which the water-based emulsion is placed is preferably in the range of 0.1 to 50 kPa, and more preferably in the range of 0.5 to 5 kPa. If the pressure of the atmosphere in which the water-based emulsion is within the above range, it is possible to remove the solvent immediately while preventing generation of a dispersoid 31 having irregular shapes effectively (that is, preventing rapid vaporization (boiling) of a solvent from the inside of the dispersoid of the water-based emulsion).

In this regard, it should be noted that it is sufficient that the removal of the solvent is carried out to the extent that at least the dispersoid is transformed into a solid state. It is not necessary to remove substantially all the solvent contained in the water-based emulsion.

The average diameter of the dispersoid 31 contained in the water-based suspension 3 is not limited to a specific value, but preferably in the range of 0.01 to 5 μm, and more preferably in the range of 0.1 to 3 μm. This makes it possible to prevent bonding (aggregation) of the particles of the dispersoid reliably, thereby enabling the size of finally obtained toner particles to be optimum size.

<Water-based Dispersion Medium Removal Step>

Next, by removing the water-based dispersion medium from the water-based dispersion liquid (water-based suspension 3), dry fine particles corresponding to the dispersoid of the water-based dispersion liquid (water-based suspension 3) is obtained (water-based dispersion medium removal step). The dry fine particles obtained in this way are used as toner particles of a liquid developer.

The removal of the water-based dispersion medium may be carried out by any method, but preferably carried out by intermittently ejecting droplets of a dispersion liquid (water-based dispersion liquid) comprised of a water-based dispersion medium and a dispersoid dispersed in the dispersion medium. This makes it possible to carry out the removal of the water-based dispersion medium efficiently while preventing aggregation of the dispersoid effectively. Further, since the removal of the water-based dispersion medium is carried out by intermittently ejecting droplets of the water-based dispersion liquid, even in the case where a part of the solvent remains in preparing the water-based suspension, it is possible to remove the remaining solvent together with the water-based dispersion medium in an effective manner.

In particular, in the present embodiment, the removal of the water-based dispersion medium is carried out using a dry fine particle production apparatus (toner particle production apparatus) as shown in FIGS. 2 and 3.

<Dry Fine Particle Production Apparatus>

As shown in FIG. 2, the dry fine particle production apparatus (toner particle production apparatus) M1 includes head portions M2 for intermittently ejecting the water-based suspension (water-based dispersion liquid) 3 in the form of droplets 9 as described above, a water-based suspension supply portion (water-based dispersion liquid supply portion) M4 for supplying the water-based suspension 3 to the head portions M2, a dispersion medium removal portion M3 in which the dispersion medium is removed while the water-based suspension 3 (droplets 9) in the form of droplets (fine particles) ejected from the head portions M2 is being conveyed, thereby to obtain dry fine particles (toner particles) 4, and a collecting portion M5 for collecting produced dry fine particles (toner particles) 4.

The water-base suspension supply portion M4 is not particularly limited as long as it has the function of supplying the water-based suspension 3 to the head portions M2. The water-based suspension supply portion M4 may be provided with a stirring means 41M for stirring the water-based suspension 3 as shown in FIG. 2. By providing such a stirring means 41M, even in the case where the dispersoid 31 is hard to be dispersed in the dispersion medium (water-based dispersion medium) 32, it is possible to supply the water-based suspension which is in a state that the dispersoid 31 is sufficiently homogeneously dispersed in the dispersion medium to the head portions M2.

Each of the head portions M2 has a function of ejecting the water-based emulsion 3 in the form of fine droplets (fine particles) 9.

Further, each of the head portions M2 has a dispersion liquid storage portion M21, a piezoelectric device (element) M22, and an ejection port (nozzle) M23. In the dispersion liquid storage portion M21, the water-based suspension 3 is stored.

The water-based suspension 3 stored in the dispersion liquid storage portion M21 is ejected from the ejection port M23 in the form of droplets 9 into the dispersion medium removal portion M3 when a pressure pulse (piezoelectric pulse) is applied.

The shape of the ejection portion M23 is not particularly limited, but preferably it is formed into a substantially circular shape. By forming the ejection portion M23 into such a shape, it is possible-to raise sphericity of the ejected water-based suspension 3 and the dry fine particle 4 formed in the dispersion medium removal portion M3.

When the ejection portion M23 has such a substantially circular shape, the diameter thereof (that is, nozzle diameter) is preferably in the range of 5 to 500 μm, and more preferably in the range of 10 to 200 μm. If the diameter of the ejection portion M23 is less than the above lower limit value, clogging is likely to occur and therefore there is a case that variations in the size of the droplets 9 to be ejected become larger. On the other hand, if the diameter of the ejection portion M23 exceeds the above upper limit value, there is a possibility that the water-based suspension 3 (droplets 9) to be ejected contains air bubbles inside thereof depending on the relative power balance between the negative pressure of the dispersion liquid storage portion M21 and the surface tension of the nozzle.

Further, it is preferred that the a portion in the vicinity of the ejection portion M23 of each head portion M2 (that is, an inner surface of the nozzle aperture of each ejection portion M23 and a surface of the head portions M2 in which the ejection portions M23 are provided (the lower surface in the drawing)) has liquid repellency (water repellency). This makes it possible to prevent the water-based suspension 3 from adhering around the ejection portion effectively. As a result, it is possible to prevent a poor formation of droplets and occurrence of defective ejection of the water-based suspension 3. Further, since adhering of the water-based suspension 3 around the ejection portion is prevented effectively, the shape stability of the droplets to be ejected is improved (variations in shape and size of the respective droplets are made small), and thus variations in shape and size of toner particles to be finally obtained can be made small.

Examples of a material having such liquid repellency include fluoro-based resins such as polytetrafluoroetylene (PTFE) and silicone-based materials.

As shown in FIG. 3, each of the piezoelectric devices M22 is formed by laminating a lower electrode (a first electrode) M221, a piezoelectric element M222, and an upper electrode (a second electrode) M223 in this order from the bottom side. In other words, each of the piezoelectric devices M22 has a structure in which the piezoelectric element M222 is provided between the upper electrode M223 and the lower electrode M221.

The piezoelectric device M22 functions as a vibration source, and the diaphragm M24 is vibrated by the piezoelectric device (vibration source) M22 to instantaneously increase the internal pressure of the ejection liquid storage portion M21.

In particular, in each of the head portions M2, the piezoelectric element M222 keeps its original shape in a state where a predetermined eject signal from a piezoelectric device driving circuit (not shown in the drawings) is not inputted, that is, in a state where a voltage is not applied across the lower electrode M221 and the upper electrode M223 of the piezoelectric device M22. At this time, since the diaphragm M24 also keeps its original shape, the volume of the dispersion liquid storage portion M21 is not changed. That is, the water-based suspension 3 is not ejected through the ejection portion M23.

On the other hand, the piezoelectric element M222 changes its shape when a predetermined eject signal from the piezoelectric device driving circuit is inputted, that is, when a predetermined voltage is applied across the lower electrode M221 and the upper electrode M223 of the piezoelectric device M22. As a result, the diaphragm M24 is significantly bent (toward-the lower side in FIG. 3), so that the volume of the dispersion liquid storage portion M21 is reduced (changed). At this time, the pressure in the dispersion liquid storage portion M21 is instantaneously increased, so that the water-based suspension 3 is ejected in the form of droplets through the ejection portion M23.

When single ejection of the water-based suspension 3 is finished, namely one droplet is formed, the piezoelectric device driving circuit stops a voltage from being applied across the lower electrode M221 and the upper electrode M223. As a result, the piezoelectric device M22 is returned to its almost original shape so that the volume of the ejection liquid storage portion M21 is increased. At this time, since pressure is exerted on the water-based suspension 3 in the direction from the water-based suspension supply portion M4 to the election portion M23 (that is, in the positive direction), it is possible to prevent air from entering the dispersion liquid storage portion M21 through the ejection portion M23. Then, the water-based suspension 3 in an amount equal to the ejected amount thereof is supplied to the dispersion liquid storage portion M21 from the water-based suspension supply portion M4.

By carrying out predetermined periodic application of a voltage in such a manner as described above, the water-based suspension 3 in the form of droplets is repeatedly ejected due to vibration of the piezoelectric device M22.

As described above, by carrying out ejection (discharge) of the water-based suspension 3 by the use of a pressure pulse due to vibration of the piezoelectric element M222, it is possible to eject the water-based suspension 3 intermittently drop by drop with the shape of each droplet 9 being stable. As a result, it is possible to make variations in shape and size of respective toner particles extremely small, thereby enabling to produce toner particles having high sphericity (a shape close to a geometrically perfect spherical shape) relatively easily.

Further, by ejecting the dispersion liquid by the use of vibration of the piezoelectric element, it is possible to eject the dispersion liquid at predetermined intervals more reliably. This makes it possible to effectively prevent collision or aggregation between the ejected droplets 9 of the dispersion liquid, thus resulting in preventing formation of defective dry fine particles 4 effectively.

The initial velocity of the water-based suspension 3 (droplets 9) at the time when the water-based suspension 3 is ejected from the head portions M2 into the dispersion medium removal portion M3 is preferably in the range of, for example, 0.1 to 10 m/sec, more preferably in the range of 2 to 8 m/sec. If the initial velocity of the water-based suspension 3 is less than the above lower limit value, productivity of toner particles is lowered. On the other hand, the initial velocity of the water-based suspension 3 exceeds the above upper limit value, the finally obtained toner particles tend to have a lower degree of sphericity.

The viscosity of the water-based suspension 3 ejected from the head portions M2 is not limited to any specific value, but is preferably in the range of, for example, 0.5 to 200 (mPa·s), more preferably in the range of 1 to 25 (mPa·s). If the viscosity of the water-based suspension 3 is less than the above lower limit value, it is difficult to control the size of each droplet of the water-based suspension to be ejected properly, thus resulting in a case where the finally obtained toner particles have large variations in size. On the other hand, if the viscosity of the water-based suspension 3 exceeds the above upper limit value, there is a tendency that each of the formed droplets has a larger diameter, the ejecting velocity of the water-based suspension 3 becomes low, and the amount of energy required to eject the water-based suspension 3 becomes large. In a case where the viscosity of the water-based suspension 3 is especially high, it is impossible to eject the water-based suspension 3 in the form of droplets.

The water-based suspension 3 to be ejected from the head portions M2 may be cooled in advance. By cooling the water-based suspension 3 in such a manner, it is possible to prevent undesirable evaporation (volatilization) of the dispersion medium 32 from the water-based suspension 3 at the vicinity of the ejection portions M23 effectively. As a result, it is possible to prevent changes in the ejected amount of the water-based suspension 3 which are caused by the fact that the diameter of each ejection portion is reduced with the elapse of time, thereby enabling to obtain toner particles having small variations in shape and size of respective particles.

The ejected amount of one droplet of the water-based suspension 3 slightly varies depending on the content of the dispersoid 31 in the water-base suspension 3, but is preferably in the range of 0.05 to 500 pl, more preferably in the range of 0.5 to 50 pl. By setting the ejected amount of one droplet of the water-based suspension 3 to a value within the above range, it is possible to obtain dry fine particles 4 each having an appropriate diameter.

Further, the average diameter of the droplets 9 ejected from the head portions M2 also varies depending on the content of the dispersoid 31 in the water-base suspension 3, but is preferably in the range of 1.0 to 100 μm, more preferably in the range of 5 to 50 μm. By setting the average diameter of the droplets 9 of the water-based suspension 3 to a value within the above range, it is possible to obtain dry fine particles 4 each having an appropriate diameter.

The frequency of the piezoelectric device M22 (the frequency of an piezoelectric pulse) is not limited to any specific value, but is preferably in the range of 1 kHz to 500 MHz, more preferably in the range of 5 kHz to 200 MHz. If the frequency of the piezoelectric device M22 is less than the above lower limit value, productivity of toner particles is lowered. On the other hand, if the frequency of the piezoelectric device M22 exceeds the above upper limit value, there is a possibility that the ejection of the water-based suspension 3 cannot follow the frequency of the piezoelectric device M22 so that the sizes of the droplets of the water-based suspension 3 become different from each other. As a result, there is a possibility that dry fine particles 4 (toner particles) finally obtained have large variations in their size.

The dry fine particle production apparatus M1 shown in FIG. 1 is provided with a plurality of head portions M2. From each of the head portions M2, a water-based emulsion 3 in the form of droplets (droplets 9) is ejected to the dispersion medium removal portion M3.

The water-based suspension 3 may be ejected at substantially the same time from all the head portions M2, but it is preferred that the water-based suspension 3 is ejected in such a manner that the timing of election is different in at least two adjacent head portions M2. This makes it possible to prevent collision and undesirable aggregation effectively between the water-based suspension 3 in the form of droplets, namely between the droplets 9 ejected from the adjacent head portions M2, before the dry fine particles 4 are formed.

Further, as shown in FIG. 2, the dry fine particle production apparatus M1 has a gas stream supply means M10, and the gas stream supply means M10 is adapted to inject gas at a substantially even pressure through a duct M101 from each of the gas injection openings M7 provided between the adjacent head portions M2. This makes it possible to convey the droplets 9 of the water-based suspension 3 intermittently ejected from the ejection portions M23 with the distance between the droplets 9 being maintained, thereby enabling to prevent collision and aggregation between the droplets effectively to obtain dry fine particles 4. As a result, it is also possible to obtain dry fine particles having small variations in their size and shape.

Further, by injecting gas supplied from the gas stream supply means M10 through the gas injection openings M7, it is possible to form an air stream flowing in substantially one direction (that is, in a downward direction in FIG. 1) in the dispersion medium removal portion M3. Such a gas stream makes it possible to efficiently convey the dry fine particles 4 produced in the dispersion medium removal portion M3. As a result, collection efficiency of dry fine particles 4 is improved, and thus productivity of a liquid developer is also improved.

Furthermore, by injecting gas through the gas injection openings M7, an air flow curtain is formed between the droplets 9 ejected from the adjacent head portions M2. Such an air curtain makes it possible to prevent collision and aggregation between the droplets effectively.

The gas stream supply means M10 is equipped with a heat exchanger M11. By providing such a heat exchanger M11, it is possible to set the temperature of gas to be injected from the gas injection openings M7 to an appropriate value, thereby enabling to efficiently remove the dispersion medium 32 from the water-based suspension 3 in the form of droplets which have been ejected into the dispersion medium removal portion M3.

Further, by providing such gas stream supply means M10, it is possible to control the dispersion medium removal rate for removing the dispersion medium 32 from the droplets of the water-based suspension 3 ejected from the ejection portions M23 easily by adjusting the amount of a gas stream to be supplied.

The temperature of gas to be injected from the gas injection openings M7 varies depending on the compositions of the dispersoid 31 and the dispersion medium 32 contained in the water-based suspension 3, but is preferably in the range of 0 to 70° C., more preferably in the range of 15 to 60° C. By setting the temperature of gas to be injected from the gas injection openings M7 to a value within the above range, it is possible to remove the dispersion medium 32 effectively from the droplets 9 while maintaining shape uniformity and shape stability of dry fine particles 4 obtained at a sufficiently high level.

The humidity of gas to be injected from the gas injection openings M7 is preferably 50% RH or less, more preferably 30% RH or less. By setting the humidity of gas to be injected from the gas injection openings M7 to 50% RH or less, it is possible to remove the dispersion medium 32 contained in the water-based suspension 3 efficiently in the dispersion medium removal portion M3, thereby further improving the productivity of the dry fine particles 4.

The dispersion medium removal portion M3 is constructed from a tubular housing M31. In order to maintain the inside of the dispersion medium removal portion M3 at a temperature within a predetermined range, a heat source or a cooling source may be provided inside or outside the housing M31, or the housing M31 may be formed as a jacket having a passage of a heat medium or a cooling medium.

In the dry fine particle production apparatus shown in FIG. 1, the pressure inside the housing M31 is adapted to be adjusted by pressure controlling means M12. By adjusting the pressure inside the housing M31, it is possible to produce dry fine particles more effectively, and as a result, productivity of a liquid developer is improved. Further, in the structure shown in the drawing, the pressure controlling means M12 is connected to the housing M31 through a connecting pipe M121. Further, a diameter expansion portion M122 is formed in the vicinity of the end portion of the connecting pipe M121 at a side which is connected to the housing M31, and a filter M123 for preventing the dry fine particles 4 and the like from being sucked into the pressure controlling means M12 is provided in the end of the diameter expansion portion M122.

The pressure inside the housing M31 is not limited to any specific value, but is preferably 150 kPa or less, more preferably in the range of 100 to 120 kPa, and even more preferably in the range of 100 to 110 kPa. By setting the pressure in the housing M31 to a value within the above range, it is possible to prevent effectively the dispersion medium 32 from being removed rapidly from the droplets 9 (that is, boiling phenomenon of the droplets 9). As a result, it is possible to produce dry fine particles 4 effectively while preventing formation of defective dry fine particles 4 reliably. In this connection, it is to be noted that the pressure inside the housing M31 may be substantially the same or different from each other at various positions thereof.

Further, voltage apply means M8 for applying a voltage to the inner surface of the housing M31 is connected to the housing M31. By applying a voltage of the same polarity as the dry fine particles 4 (droplets 9) to the inner surface of the housing M31 by the use of the voltage apply means M8, it is possible to obtain such effects as described below.

Generally, the dry fine particles 4 are positively or negatively charged. Therefore, when there is any charged matter of polarity opposite to that of the dry fine particles 4, the phenomenon in which the dry fine particles 4 are electrostatically attracted and adhered to the charged matter occurs. On the other hand, when there is any charged matter of the same polarity as that of the dry fine particles 4, the charged matter repels each another, thereby effectively preventing the phenomenon in which the dry fine particles 4 adhere to the surface of the charged matter. For this reason, by applying a voltage of the same polarity as that of the dry fine particles 4 to the side of the inner surface of the housing M31, it is possible to prevent effectively the dry fine particles 4 from adhering to the inner surface of the housing M31. As a result, it is also possible to prevent effectively the formation of defective dry fine particles 4 as well as to improve the collection efficiency of the dry fine particles 4.

The housing M31 further includes a reduced-diameter portion M331 in the bottom portion thereof. In the reduced-diameter portion M311, the inner diameter thereof is reduced toward the lower side in FIG. 2. By providing such a reduced-diameter portion M311, it is possible to collect the dry fine particles 4 efficiently.

The dry fine particles 4 obtained in this way are collected in the collection portion M5.

Normally, the thus obtained dry fine particles 4 have size and shape corresponding to each dispersoid 31. Therefore, a finally obtained liquid developer contains toner particles each having a relatively small diameter and a high degree of roundness (sphericity) and having small variations in shape and size of the respective particles.

Further, the thus obtained dry fine particles 4 may be particles obtained by removing the dispersion medium 32 of the water-based suspension 3, and in such a case a part of the dispersion medium may remain inside thereof.

Furthermore, the thus obtained dry fine particles 4 may be subjected to the dispersion step described later as they are or subjected to various treatments such as heat treatment. This makes it possible to further enhance the mechanical strength (shape stability) of the dry fine particles (toner particles) and the water content in the dry fine particles can be lowered. Further, it is also possible to lower the water content of the dry fine particles 4 as is the same as the above by subjecting the thus obtained dry fine particles 4 to a treatment such as aeration, or placing the dry fine particles 4 in an atmosphere under reduced pressure.

Moreover, the thus obtained dry fine particles 4 may be subjected to other various treatments such as classification, and external addition and the like.

<Preparation of Insulation Liquid>

The insulation liquid described above can be prepared in accordance with the following method, for example. In this regard, it is to be noted that the following explanation is based on the case that an insulation liquid contains an oxidation polymerization accelerator with being encapsulated.

Encapsulation of the oxidation polymerization accelerator is carried out as follows.

First, an oxidation polymerization accelerator is prepared. Then, the oxidation polymerization accelerator is dissolved by a solvent.

No specific limitation is imposed on the kind of such a solvent if the oxidation polymerization accelerator can be dissolved therein.

Examples of such solvents include inorganic solvents such as carbon disulfide, and carbon tetrachloride, and organic solvents such as ketone-based solvents (e.g., methyl ethyl ketone (MEK), methyl isopropyl ketone (MIPK), and 2-heptanone), alcohol-based solvents (e.g., pentanol, n-hexanol, 1-octanol, and 2-octanol), ether-based solvents (e.g., diethyl ether, and anisole), aliphatic hydrocarbon-based solvents (e.g., hexane, pentane, heptane, cyclohexane, octane, and isoprene), aromatic hydrocarbon-based solvents (e.g., toluene, xylene, benzene. ethyl benzene, and naphthalene), aromatic heterocyclic compound-based solvents (e.g., furan, and thiophene), halide-based solvents (e.g., chloroform), ester-based solvents (e.g., ethyl acetate, isopropyl acetate, isobutyl acetate, and ethyl acrylate), nitrile-based solvents (e.g., acrylonitrile), and nitro-based solvents (e.g., nitromethane and nitroethane). These materials can be used singly or in combination of two or more of them.

Next, porous bodies such as hydrophilic silica. hydrophilic alumina, hydrophilic titanium oxide and the like are added to the thus obtained solution so that the solution is adsorbed by the porous bodies.

Next, the porous bodies adsorbing the solution is mixed with a polyether such as polyethyleneglycol, polypropyleneglycol and the like in a heating state. The mixing ratio of the porous bodies and the polyether is preferably in the rage of 1:0.5 to 1:10, and more preferably in the range of 1:1to 1:5. Further, the temperature at the time when the porous bodies and the polyether are mixed is preferably in the range of 5 to 80° C., and more preferably in the range of 20 to 80° C.

Next, the thus obtained mixture is dispersed into a petroleum carbon hydride sufficiently, and then it is cooled down so that the polyether is settled down on the surfaces of the porous bodies. Consequently, a coating of polyether is formed on the surfaces of the porous bodies.

Then, the petroleum carbon hydride is removed by filtering it to obtain an encapsulated oxidation polymerization accelerator.

The encapsulated oxidation polymerization accelerator obtained in this way can have higher dispersibility to the unsaturated fatty acid glyceride.

By dispersing the encapsulated oxidation polymerization accelerator obtained in this way into a liquid mainly composed of the unsaturated fatty acid glyceride, the insulation liquid of the present invention can be obtained.

In this regard, it is to be noted that the antioxidizing agent may be added to the insulation liquid before or after the dispersion of the oxidation polymerization accelerator or at the same time of the dispersion of the oxidation polymerization accelerator.

<Dispersing Step>

Next, the dry fine particles 4 prepared through the processes described above is dispersed into an insulation liquid (dispersing step). In this way, it is possible to obtain a liquid developer in which toner particles comprised of the dry fine particles 4 are dispersed in the insulation liquid (carrier liquid).

Various methods can be used for dispersing the dry fine particles 4 into the insulation liquid. However, it is preferred that the dispersion is carried out by adding the dry fine particles 4 into an insulation liquid that is being stirred. This makes it possible to prevent undesirable aggregation of the dry fine particles 4 in preparing the liquid developer, so that the obtained liquid developer can keep a satisfactory dispersing state of the toner particles 4 for a long period of time in a stable manner.

<Liquid Developer>

The liquid developer obtained as described above has small variations in shape and size of the toner particles. Therefore, in such a liquid developer, toner particles are easy to migrate in the insulation liquid (that is, in the liquid developer), and thus it is advantageous in high speed development. Further, since the toner particles have small variations in their shape and size and the insulation liquid as described above is used, the toner particles have superior dispersibility, so that settle down and floating of the toner particles in the liquid developer are prevented effectively. Therefore, such a liquid developer can keep superior storage stability or preservability for a long period of time.

Next, a description will be made with regard to preferred embodiments of an image forming apparatus to which a liquid developer of the present invention can be applied.

Figure 4:
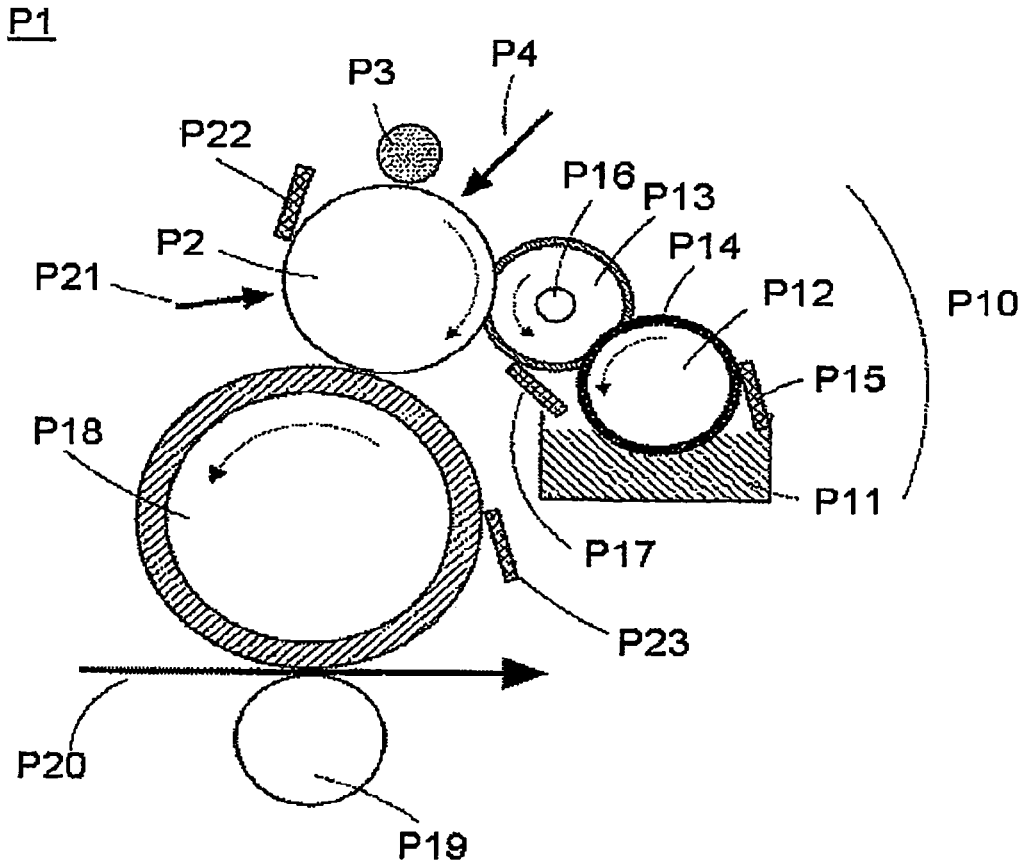
FIG. 4 is a cross-sectional view of one example of a contact type image forming apparatus in which the liquid developer of the present invention can be used.

FIG. 4 is an illustration which shows one example of a contact type image forming apparatus to which the liquid developer of the present invention can be applied. The image forming apparatus P1 includes a photoreceptor P2 in the form of a cylindrical drum. After the surface of the photoreceptor P2 is uniformly charged with a charging device P3 made of an epichlorohydrin rubber or the like, exposure P4 corresponding to the information to be recorded is carried out using a laser diode or the like so that an electrostatic latent image is formed.

A developer P10 has an application roller P12 a part of which is immersed in a developer container P11 and a development roller P13. The application roller P12 is formed form, for example, a gravure roller made of stainless steel or the like, which rotates with opposing to the development roller P13. On the surface of the application roller P12, a liquid developer application layer P14 is formed, and the thickness of the layer is adapted to be kept constant by a metering blade P15.

Further, a liquid developer is transferred from the application roller P12 to the development roller P13. The development roller P13 is constructed from a metallic roller core member P16 made from stainless steel or the like, a low hardness silicone rubber layer provided on the metallic core member P16, and a resin layer made of a conductive PFA (polytetrafluoroetylene-perfluorovinylether copolymer) formed on the silicone rubber layer. The development roller P13 is adapted to rotate at the same speed as the photoreceptor P2 to transfer the liquid developer to a latent image section. A part of the liquid developer remaining on the development roller P13 after it has been transferred to the photoreceptor P2 is removed by the a development roller cleaning blade P17 and then collected in the developer container P11.

Further, after a toner image is transferred from the photoreceptor to an intermediate transfer roller P18, the photoreceptor is discharged with discharging light P21, and a toner which has not been transferred and remains on the photoreceptor P2 is removed by a cleaning blade P22 made of a urethane rubber or the like.

In a similar manner, a toner which is not transferred and remains on the intermediate transfer roller P18 after the toner image has been transferred to an information recording medium P20 is removed by a cleaning blade P23 made of a urethane rubber or the like.

The toner image formed on the photoreceptor P2 is transferred to the intermediate transfer roller P18. Then, a transfer current is supplied to a secondary transfer roller P19, and the toner image transferred on the intermediate roller P18 is transferred onto the recording medium P20 such as a paper which passes between the intermediate transfer rollers P18 and the secondary transfer roller P19. Thereafter, the toner image on the recording medium P20 is fixed thereto using a fixing unit shown in FIG. 6.

Figure 5:
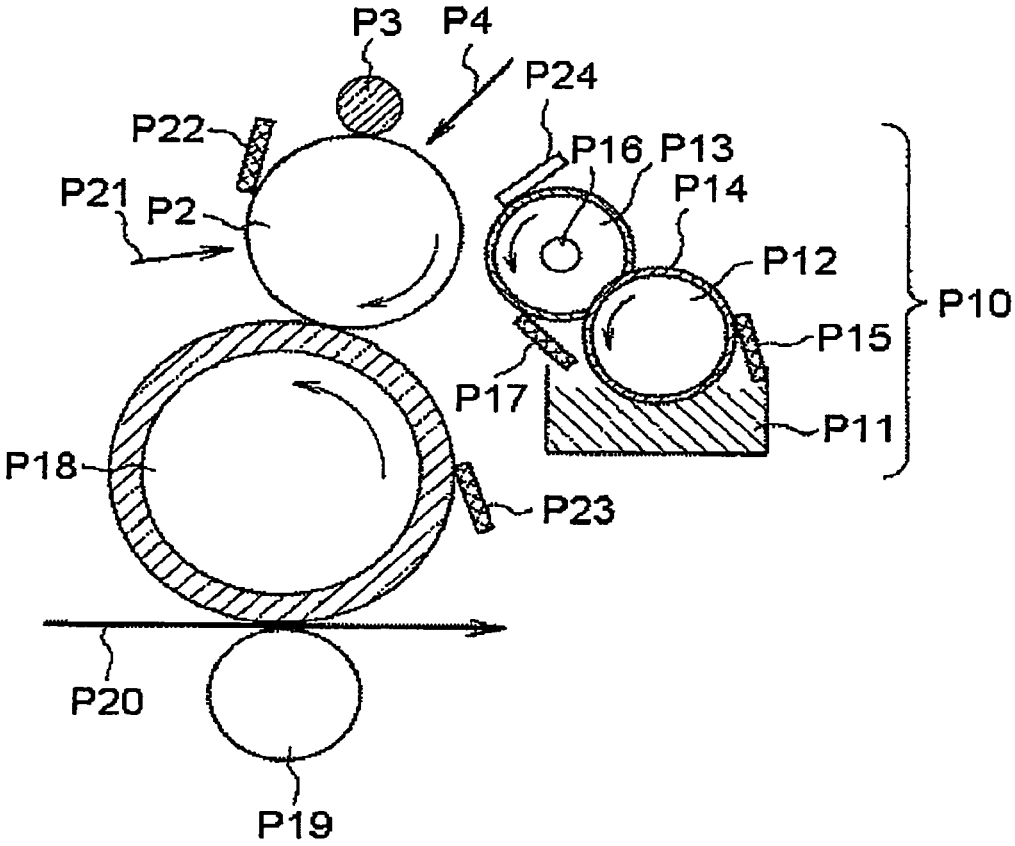
FIG. 5 is a cross sectional view of one example of a non-contact type image forming apparatus in which the liquid developer of the present invention can be used.

FIG. 5 shows one example of a non-contact type image forming apparatus to which the liquid developer according to the present invention can be applied. In such a non-contact type image forming apparatus, a development roller P13 is provided with a charging blade K24 which is formed from a phosphor-bronze plate having a thickness of 0.5 mm. The charging blade K24 has a function of causing a layer of the liquid developer to be charged by contacting it. Further, since an application roller P12 is a gravure roller, a layer of a developer having irregularities which correspond to irregularities on the surface of the gravure roller is formed on the development roller P13. The charging blade K24 also has a function of uniforming the irregularities formed on the development roller P13. The orientation of the charging blade K24 is either of a counter direction or a trail direction with respect to the rotational direction of the development roller. Further, the charging blade K24 may be in the form of a roller not a blade.

Preferably, between the development roller P13 and the photoreceptor P2, there is formed a gap whose width is 200 μm to 800 μm, and an AC voltage having 500 to 3000 Vpp and a frequency of 50 to 3000 Hz which is superimposed on a DC voltage of 200 to 800 V is applied across the development roller P13 and the photoreceptor P2. Other structures of this non-contact type image forming apparatus are the same as those of the contact type image forming apparatus shown in FIG. 4.

In the foregoing, the description was made with regard to the image formation by the embodiments shown in FIGS. 4 and 5 in which a liquid developer of one color is used. However, it goes without saying that when an image is formed using color toners of a plurality of colors, a color image can be formed by using a plurality of development apparatuses corresponding to the respective colors to form images of the respective colors.

Figure 6:
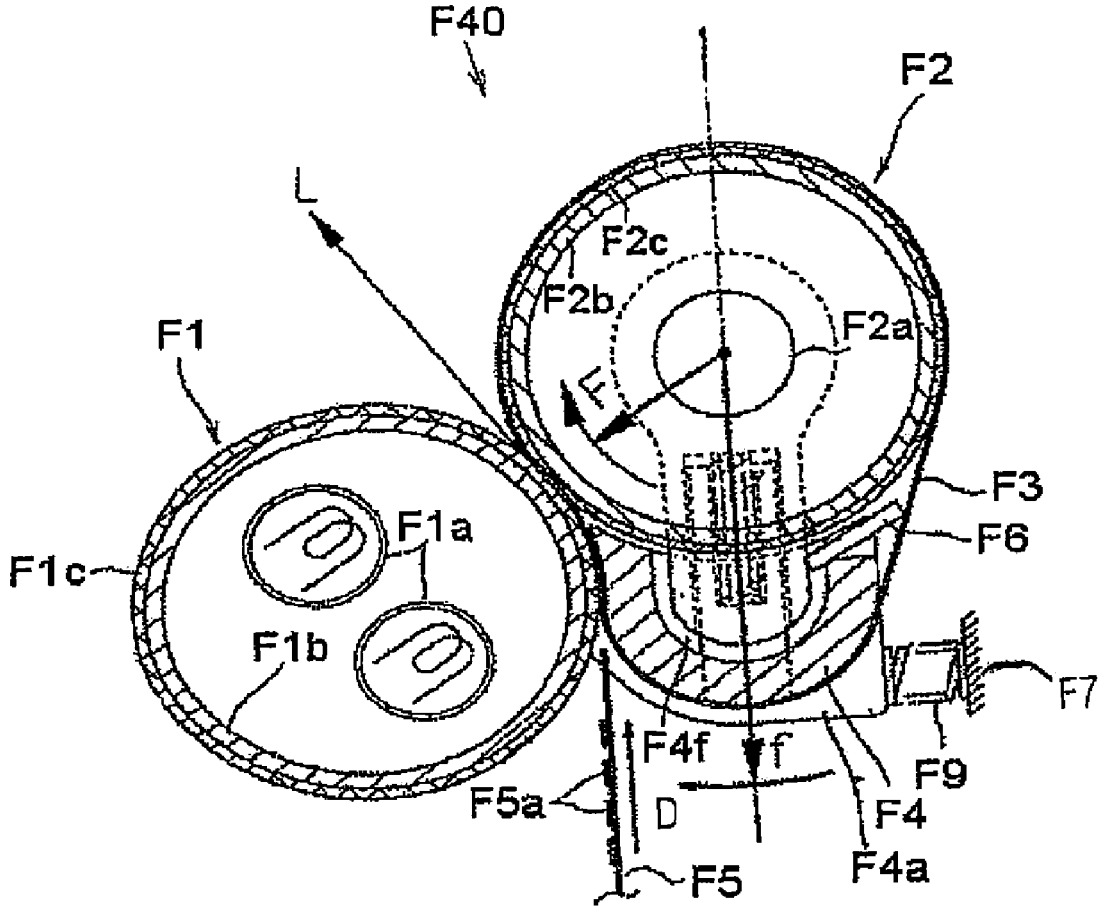
FIG. 6 is a cross-sectional view which shows one example of a fixing apparatus in which the liquid developer of the present invention can be used.

FIG. 6 is a cross-sectional view of a fixing unit, in which F1 denotes a heat fixing roller, F1*a* denotes halogen lamps, F1*b* is a roller base, F1*c* is an elastic body, F2 is a pressure roller, F2*a* is a rotation shaft, F2*b* is a roller base, F2*c* is an elastic body, F3 is a heat resistant belt, F4 is a belt tension member, F4*a* is a protruding wall, F5 is a sheet material, F5*a* is an unfixed toner image, F6 is a cleaning member, F7 is a frame, F9 is a spring, and L is a tangential line of a pressing part.

As shown in this figure, the fixing unit F40 includes the heat fixing roller (hereinafter, also referred to as "heat fuser roller") F1, the pressure roller F2, the heat resistant belt F3, the belt tension member F4, and the cleaning member F6.

The heat fixing roller F1 has the roller base F1*b* formed from a pipe member having an outer diameter of about 25 mm and a thickness of about 0.7 mm. The roller base F1*b* is coated with the elastic body F1*c* having a thickness of about 0.4 mm. Further, inside the roller base F1*b*, two halogen lamps F1*a* which act as a heat source is provided. Each of the halogen lamps F1*a* has a tubular shape and an output of 1,050 W. The heat fixing roller F1 is rotatable in an anticlockwise direction shown by the arrow in FIG. 6. Further, the pressure roller F2 has the roller base F2*b* formed from a pipe member having an outer diameter of about 25 mm and a thickness of about 0.7 mm. The roller base F2b is coated with the elastic body F2*c* having a thickness of about 0.2 mm. The pressure roller F2 having the above structures is rotatable in a clockwise direction indicated by the arrow F in FIG. 6, and it is arranged so as to face the heat fixing roller F1 so that a pressing pressure between the heat fixing roller F1 and the pressure roller F2 becomes 10 kg or less and a nip length therebetween is about 10 mm.

As described above, each of the heat fixing roller F1 and the pressure roller F2 is formed to have a small outer diameter of about 25 mm, there is less possibility that a sheet material F5 after the fixing process is wound around the heat fixing roller F1 or the heat resistant belt F3, and thus it is not necessary to have any means for peeling off the sheet material F5 forcibly. Further, since the PFA layer having a thickness of about 30 μm is provided on the surface of the elastic member F1*c* of the heat fixing roller F1, the strength thereof is improved. By providing such a PFA layer, both the elastic members F1*c* and F2*c* are elastically deformed substantially uniformly though their thicknesses are different from each other, thereby forming a so-called horizontal nip. Further, there is no difference between the circumferential velocity of the heat fixing roller F1 and the conveying speed of the heat resistant belt F3 or the sheet material F5. For these reasons, it is possible to perform an extremely stable image fixation.

Further, as described above, the two halogen lamps F1*a*, F1*a* which act as a heat source are provided inside the heat fixing roller F1. These halogen lamps F1*a*, F1*a* are provided with heating elements, respectively, which are arranged at different positions. With this arrangement, by selectively lighting up any one or both of the halogen lamps F1*a*, F1*a*, it is possible to easily carry out a temperature control under different conditions such as a case where a wide sheet material is used or a narrow sheet material is used, and/or a case where a fixing nip part at which the heat resistant belt F3 is wound around the heat fixing roller F1 is to be heated or a part at which the belt tension member F4 is in slidably contact with the heat fixing roller F1 is to be heated.

The heat resistant belt F3 is a ring-shaped endless belt, and it is wound around the outer circumferences of the pressure roller F2 and the belt tension member F4 so that it can be moved with being held between the heat fixing roller F1 and the pressure roller F2 in a pressed state. The heat resistant belt F3 is formed from a seamless tube having a thickness of 0.03 mm or more. Further, the seamless tube has a two layered structure in which its surface (which is the surface thereof that makes contact with the sheet material F5) is formed of PFA, and the opposite surface thereof (that is, the surface thereof that makes contact with the pressure roller F2 and the belt tension member F4) is formed of polyimide. However, the structure of the heat resistant belt F3 is not limited to the structure described above, it may be formed from other materials. Examples of tubes formed from other materials include a metallia tube such as a stainless tube or a nickel electrocasting tube, a heat-resistance resin tube such as a silicone tube, and the like.

The belt tension member F4 is disposed on the upstream side of the fixing nip part between the heat fixing roller F1 and the pressure roller F2 in the sheet material F5 conveying direction. Further, the belt tension member F4 is pivotally disposed about the rotation shaft F2*a* of the pressure roller F2 so as to be movable along the arrow D. The belt tension member F4 is constructed so that the heat resistant belt F3 is extended with tension in the tangential direction of the heat fixing roller F1 in a state that the sheet material F5 does not pass through the fixing nip part. When the fixing pressure is large at an initial position where the sheet material F5 enters the fixing nip part, there is a case that the sheet material F5 can not enter the fixing nip part smoothly and thereby fixation is performed in a state that a tip part of the sheet material F5 is folded. However, in this embodiment, the belt tension member F4 is provided so that the heat resistant belt F3 is extended with tension in the tangential direction of the heat fixing roller F1 as described above, there is formed an introducing portion for smoothly introducing the sheet material F5, so that the sheet material F5 can be introduced into the fixing nip part in a stable manner.

The belt tension member F4 is a roughly semicircular member for slidably guiding the heat resistant belt F3 (the heat resistant belt F3 slidably moves on the belt tension member F4). The belt tension member P4 is fitted into the inside of the heat resistant belt F3 so as to impart tension f to the heat resistant belt F3 in cooperation with the pressure roller F2. The belt tension member F4 is arranged at a position where a nip part is formed by pressing a part of the heat resistant belt F3 toward the heat fixing roller F1 over the tangential line L on the pressing portion at which the heat fixing roller F1 is pressed against the pressure roller F2. The protruding wall F4*a* is formed on any one or both of the end surfaces of the belt tension member F4 which are located in the axial direction thereof. The protruding wall F4 is provided for restricting the heat resistant belt F3 from being off to the side by abutment thereto in a case that the heat resistant belt F3 is deviated in any one of the sides. Further, a spring F9 is provided between the frame and an end portion of the protruding wall F4*a* which is located at an opposite side from the heat fixing roller F1 so as to slightly press the protruding wall F4*a* of the belt tension member F4 against the heat fixing roller F1. In this way, the belt tension member F4 is positioned with respect to the heat fixing roll F1 in slidably contact with the heat fixing roller F1.

In order to stably drive the heat resistant belt F3 by the pressure roller F2 in a state that the heat resistant belt F3 is wound around the pressure roller F2 and the belt tension member F4, the frictional coefficient between the pressure roll F2 and the heat resistant belt F3 is set to be larger than the frictional coefficient between the belt tension member F4 and the heat resistant belt F3. However, there is a case that these frictional coefficients become unstable due to enter of foreign substances between the heat resistant belt F3 and the pressure roller F2 or between the heat resistant belt F3 and the belt tension member F4, or due to the abrasion of the contacting part between the heat resistant belt F3 and the pressure roller F2 or the belt tension member F4.

Accordingly, the winding angle of the heat resistant belt F3 with respect to the belt tension member F4 is set to be smaller than the winding angle of the heat resistant belt F3 with respect to the pressure roller F2, and the diameter of the belt tension member F4 is set to be smaller than the diameter of the pressure roller F2. With this structure, the distance that the heat resistant belt F3 moves on the belt tension member F4 becomes short so that unstable factors due to deterioration with the elapse of time and disturbance can be avoided or reduced. As a result, it is possible to drive the heat resistant belt F3 with the pressure roller F2 in stable manner.

The cleaning member F6 is disposed between the pressure roller F2 and the belt tension member F4. The cleaning member F6 is provided for cleaning foreign substances or wear debris on the inner surface of the heat resistant belt F3 by slidably contacting with the inner surface of the heat resistant belt F3. By cleaning the foreign substances and wear debris in this way, it is possible to refresh the heat resistant belt F3 to eliminate the unstable factors on the frictional coefficients described above. Further, the belt tension member F4 is formed with a concave portion F4*f*, and this concave portion F4*f* is preferably used for collecting the foreign substances or wear debris eliminated from the heat resistant belt F3.

A position where the belt tension member F4 is slightly pressed against the heat fixing roller F1 is set as a nip beginning position and a position where the pressure roller F2 is pressed against the heat fixing roller F1 is set as nip ending position. The sheet material F5 enters the fixing nip part from the nip beginning position to passes through between the heat resistant belt F3 and the heat fixing roller F1, and then fed out from the nip ending position, and during these processes an unfixed toner image F5*a* is fixed on the sheet material F5 and then the sheet material F5 is discharged along the tangential line L of the pressing part between the heat fixing roller F1 and the pressing roller F2.

The temperature for fixing an unfixed toner image is preferably in the range of 100 to 200° C., and more preferably 100 to 180° C. When the fixing temperature is in the above range, oxidation polymerization reaction of the unsaturated fatty acid glyceride by the oxidation polymerization accelerator upon supply of oxygen can be progressed effectively. As a result, it is possible to increase fixing strength of the toner particles more effectively.

In the foregoing, the present invention was described based on the preferred embodiments, but the present invention is not limited to these embodiments.

For example, the liquid developer of the present invention is not limited to one produced by the method described above, and the liquid developer may be produced by other various methods. For example, the ground material described above is melted by heating it and then thus melted material is dispersed in the unsaturated fatty acid glyceride, and after the unsaturated fatty acid glyceride is cooled, the oxidation polymerization accelerator may be added thereto.

Further, the method for encapsulating the oxidation polymerization accelerator is also not limited to the method described above.

Furthermore, each element constituting the dry fine particle production apparatus may be replaced with other element that exhibits the same or similar function, or additional element may be added to the apparatus.

Further, the liquid developer of the present invention is not limited to one that is used in the image forming apparatus as described above.

Furthermore, in the above described embodiments, after the dry fine particles obtained in the water-based dispersion medium removal step is once collected, the dry fine particles are subjected to the dispersion step. However, the dry fine particles may be directly subjected to the dispersion step without collecting the dry fine particles as powder. Further, the dry fine particle production apparatus shown in the drawings may be of the type that stores an insulation liquid therein and has a dispersion portion to which produced dry fine particles are supplied. This makes it possible to produce a liquid developer more effectively and prevent occurrence of undesirable aggregation among the dry fine particles more effectively.

Figure 7:
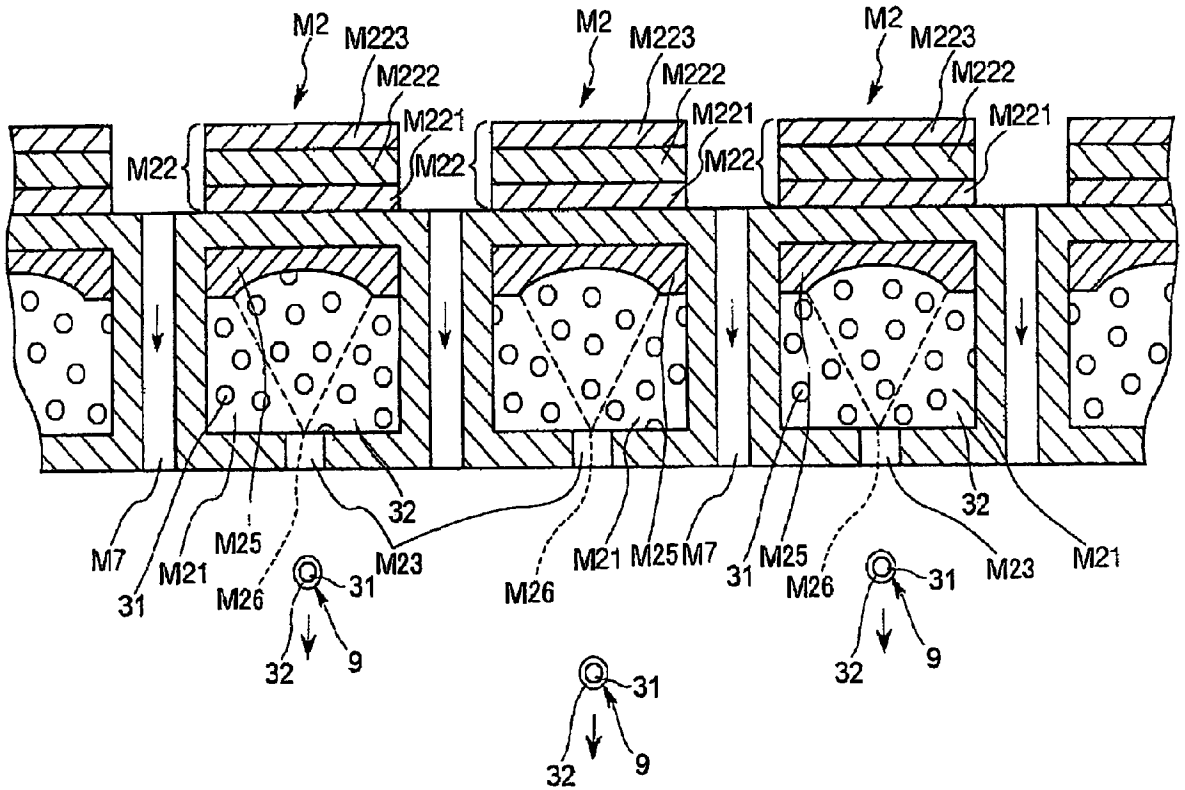
FIG. 7 is an illustration which schematically shows another example of the structure in the vicinity of the head portion of the dry fine particle producing apparatus.

Moreover, as shown in FIG. 7, an acoustic lens (a concave lens) M25 may be provided in each head portion M2. By providing such an acoustic lens M25, it is possible to converge a pressure pulse (vibration energy) generated by a piezoelectric device M22 at a pressure pulse convergence portion M26 provided in the vicinity of each ejection portion M23. Therefore, vibration energy generated by the piezoelectric device M22 is efficiently used as energy for ejecting the water-based suspension 3. Consequently, even when the water-based suspension 3 stored in the dispersion liquid storage portion M21 has a relatively high viscosity, the water-based suspension 3 is ejected from the ejection portion M23 reliably. Furthermore, even when the water-based suspension 3 stored in the dispersion liquid storage portion M21 has a relatively large cohesive force (surface tension), the water-based suspension 3 is ejected in the form of fine droplets. As a result, it is possible to control the dry fine particles (toner particles) 9 so as to have a relatively small particle size easily and reliably.

As described above, by the use of the head portion as shown in FIG. 7, it is possible to control the dry fine particles 4 so that they have desired shape and size, even when a material having a relatively high viscosity or a material having a relatively large cohesive force is used as the water-based suspension 3. This extends the range of material choices, thereby enabling to produce toner particles having desired properties easily.

Further, by the use of the head portions as shown in FIG. 7, since the water-based suspension 3 is ejected using a convergent pressure pulse, the water-based suspension 3 in the form of droplets each having a relatively small size can be ejected, even in a case where the area (the area of an opening) of the ejecting portion M23 is relatively large. In other words, even if it is desired that the dry fine particles 4 have a relatively small particle size, the area of the ejection portion M23 may be large. This makes it possible to prevent the occurrence of clogging in the ejection portion M23 more effectively even when the water-based suspension 3 has a relatively high viscosity.

In this regard, although in the head portions as shown in FIG. 7 a concave lens is used as the acoustic lens, the acoustic lens is not limited thereto. For example, a fresnel lens or an electronic scanning lens may also be used as an acoustic lens.

Figure 8:
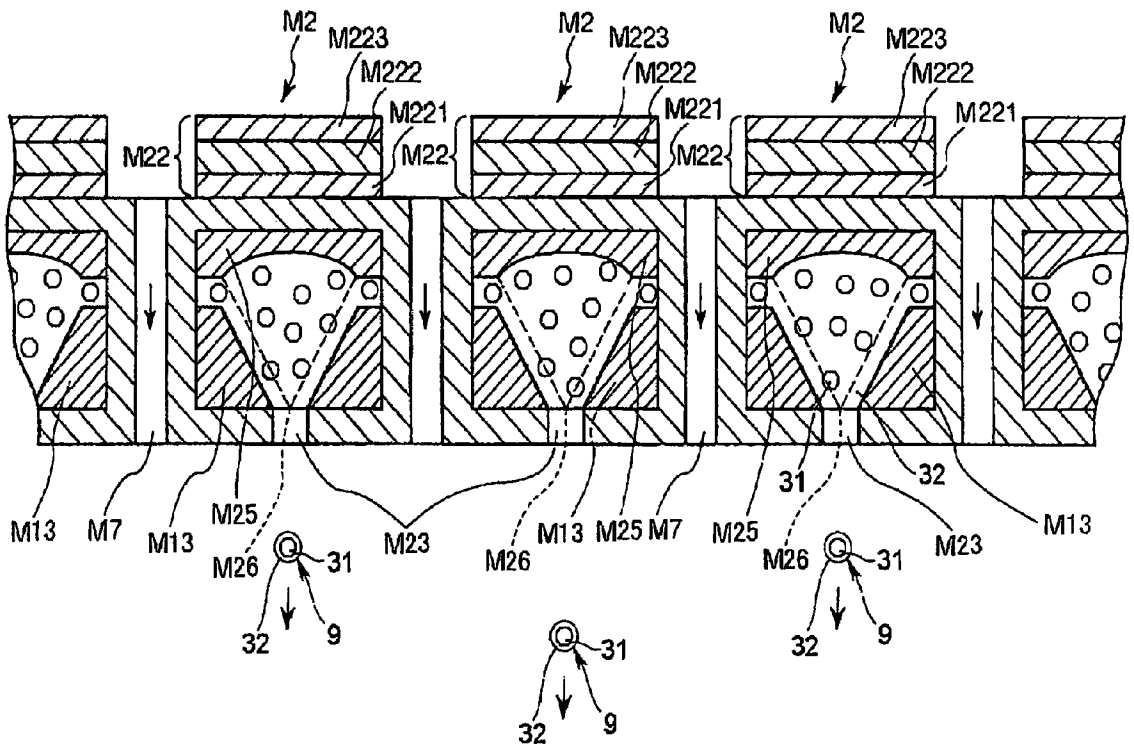
FIG. 8 is an illustration which schematically shows the other example of the structure in the vicinity of the head portion of the dry fine particle producing apparatus.
Figure 9:
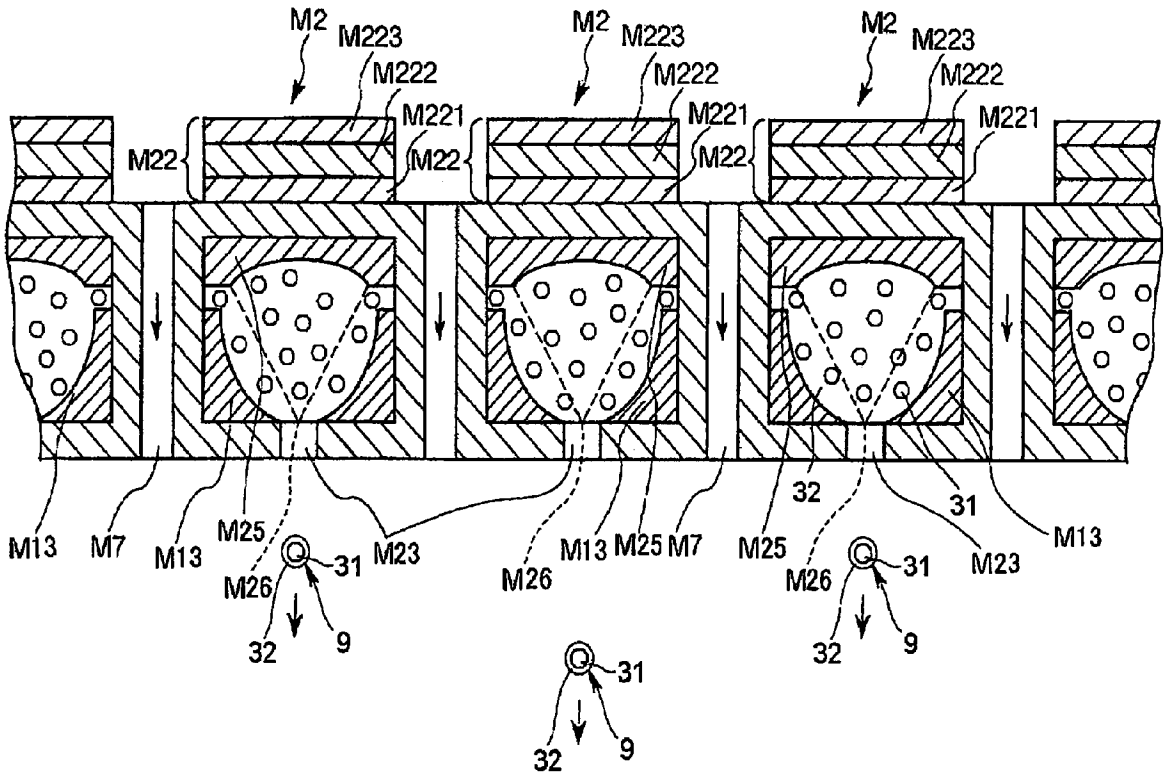
FIG. 9 is an illustration which schematically shows still other example of the structure in the vicinity of the head portion of the dry fine particle producing apparatus.
Figure 10:
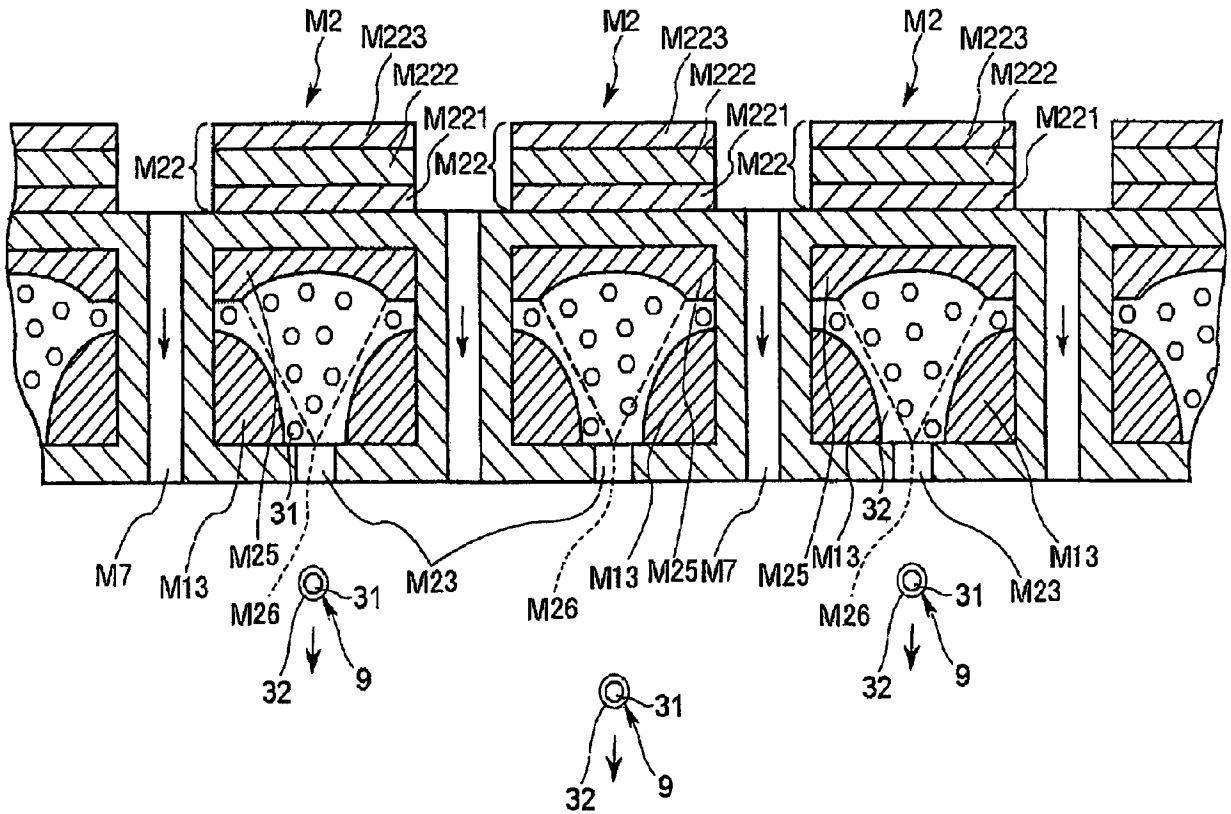
FIG. 10 is an illustration which schematically shows yet other example of the structure in the vicinity of the head portion of the dry fine particle producing apparatus.

Further, head portions as shown in FIG. 8 to FIG. 10 can be used instead of the head portions of the dry fine particle production apparatus in the above embodiment. In particular, a focusing member M13 having a shape convergent toward the ejection portion M23 may be provided between the acoustic lens M25 and-the ejection portion M23, as shown in FIGS. 8 to 10. Such a focusing member helps the convergence of a pressure pulse (vibration energy) generated by the piezoelectric device M22, and therefore the pressure pulse generated by the piezoelectric device M22 is utilized more efficiently.

Furthermore, although in each of the embodiments described above the constituent material of the toner particles is contained in a dispersoid as a solid component thereof, but at least a part of the constituent material of the toner particles may be contained in a dispersion medium.

Further, although each of the embodiments described above has a structure in which the dispersion liquid (water-based suspension) is intermittently ejected from the head portions by the use of a piezoelectric pulse, the dispersion liquid may be ejected (discharged) by other methods. Examples of such other methods include a spray dry method, the so-called Bubble Jet method ("Bubble Jet" is a trademark) and a method disclosed in Japanese Patent Application No. 2002-321889, and the like. In the method disclosed in the Japanese Patent Application, a dispersion liquid is ejected in the form of droplets using a specific nozzle in which a dispersion liquid is transformed into a thin laminar flow by thinly expanding the dispersion liquid by forcing it onto a smooth flat surface using a gas flow, and then separating the thin laminar flow from the flat smooth surface to eject it in the form of droplets. The spray dry method is a method which obtains droplets by ejecting (spraying) a liquid (a dispersion liquid) using high pressure gas. Further, as an example of a method using the Bubble Jet method ("Bubble Jet" is a trademark), a method disclosed in Japanese Patent Application No. 2002-169348 and the like can be mentioned. Namely, the dispersion liquid may be ejected (discharged) by a method in which a dispersion liquid is intermittently ejected from a head portion using a volume change of gas.

Moreover, formation of the dry fine particles may be carried out without using the ejection of the dispersion liquid (water-based suspension). For example, it is possible to obtain dry fine particles by filtering the water-based suspension to filter out fine particles corresponding to a dispersoid.

Moreover, in the above embodiments, dry fine particles each having shape and size corresponding to each particle of the dispersoid contained in the water-based suspension is obtained. However, the dry fine particles of the present invention may be formed from aggregates which are formed by aggregating (or bonding) a plurality of particles of a dispersoid contained in the water-based suspension.

Moreover, in the above embodiments, a water-based emulsion is prepared using ground particles obtained by grinding the kneaded material, but such a grinding step of the kneaded material may be omitted.

Moreover, a method for preparing the water-based emulsion and the water-based suspension is not limited to the method described above. For example, it is possible to obtain a water-based emulsion by heating a dispersion liquid in which a solid state dispersoid is dispersed to transform the dispersoid into a liquid state, and then by cooling the water-based to obtain a water-based suspension.

Moreover, in the embodiments described above, once after a water-based suspension is obtained using a water-based emulsion, dry fine particles are produced using the water-based suspension. However, the dry fine particles may be produced directly from the water-based emulsion without using the water-based suspension. For example, it is possible to obtain dry fine particles by ejecting the water-based emulsion in the form of droplets, and then removing the dispersion medium together with the solvent contained in the dispersoid from the droplets.

Moreover, the unsaturated fatty acids used in the present invention may be an unsaturated fatty acid obtained by synthesis.

EXAMPLE

(1) Production of Liquid Developer

Example 1

[Production of Dry Fine Particles]

First, 80 parts by weight of an epoxy resin (EPICOAT 1004, softening point $T_f$ thereof was 128° C.) as a binder resin, and 20 parts by weight of a cyanine pigment ("Pigment Blue 15:3", manufactured by Dainichiseika Color & Chemicals Mfg. Co., Ltd.) as a coloring agent were prepared.

These components were mixed using a 20 L type Henschel mixer to obtain a material for producing toner particles.

Next, the material (mixture) was kneaded using a biaxial kneader-extruder shown in FIG. 1. The entire length of a process section of the biaxial kneader-extruder was 160 cm. Further, the material temperature in the process section was set to be 105 to 115° C. Furthermore, the rotational speed of the screw was 120 rpm, and the speed for feeding the material into the kneader-extruder was 20 kg/hour.

Under these conditions, the time required for the material to pass through the process section was about 4 minutes.

The kneading was carried out with deairing the inside of the process section by driving a vacuum pump connected to the process section through a deairing port.

The material (kneaded material) kneaded in the process section was extruded outside the biaxial kneader-extruder from the head portion. The temperature of the kneaded material at the head portion was adjusted to be 130° C.

The kneaded material extruded from the extruding port of the biaxial kneader-extruder was cooled by a cooling machine as shown in FIG. 1. The temperature of the kneaded material just after the cooling process was about 45° C.

The cooling rate of the kneaded material was 9° C./sec. Further, the time required for the completion of the cooling process from the end of the kneading process was 10 seconds.

The kneaded material that had been cooled as described above was coarsely ground using a hammer mil to be formed into powder (ground material) having an average particle size of 1.5 mm.

Next, 250 parts by weight of toluene was added to 100 parts by weight of the coarse kneaded material, and then it was subjected to a treatment using an ultrasound homogenizer (output: 400 μA) for one hour to obtain a solution in which the epoxy resin of the kneaded material was dissolved. In the solution, the pigment was finely dispersed homogeneously.

Further, 1 part by weight of sodium-dodecylbenzenesulfonic acid as a dispersant was mixed with 700 parts by weight of ion-exchanged water to obtain a water-based liquid.

The water-based liquid was stirred with a homomixer (PRIMIX Corporation) with the number of stirring being adjusted.

The above-mentioned solution (that is, the toluene solution of the kneaded material) was dropped in the water-based liquid which is being stirred, to obtain a water-based emulsion in which a dispersoid comprised of particles having an average particle size of 3 μm was homogeneously dispersed.

Thereafter, the toluene in the water-based emulsion was removed under the conditions in which a temperature was 100° C. and an-ambience pressure was 80 kPa, and then it was cooled to room temperature. Then, a predetermined amount of water was added thereto so that the concentration was adjusted to thereby obtain a water-based suspension in which solid fine particles were dispersed. In the thus obtained water-based suspension, substantially no toluene remained. The concentration of the solid component (dispersoid) of the thus obtained water-based suspension was 28.8 wt %. Further, the average particle size of the particles of the dispersoid (solid fine particles) dispersed in the suspension was 1.2 μm. The measurement of the average particle size was carried out using a laser diffraction/scattering type particle size distribution measurement apparatus ("LA-920" which is a product name of HORIBA Ltd.).

The thus obtained suspension was put into a water-based suspension supply section of a dry fine particle production apparatus shown in FIGS. 2 and 3. The water-based suspension in the water-based suspension supply section was being stirred with a stirring means, and it was supplied to head portions by a metering pump so the suspension was ejected (discharged) to a dispersion medium removal section through ejection portions. Each ejection portion was a circular opening having a diameter of 25 μm. The head portions were of the type that a hydrophobic treatment was made around the ejection portions thereof with a fluorine resin (polytetrafluoroethylene) coating. Further, the temperature of the water-based suspension in the water-based suspension supply section was adjusted to be 25° C.

The ejection of the water-based suspension was carried out under the conditions that the temperature of the dispersion liquid in the head portions was 25° C., the frequency of vibration of each piezoelectric element was 10 kHz, the initial velocity of the dispersion liquid ejected from the ejection portions was 3 m/sec, and the size of one droplet ejected from each head portion was 4 pl (the diameter thereof was 20.8 μm). Further, the ejection of the water-based suspension was carried out so that the ejection timing of the water-based suspension was changed at least in the adjacent head portions in the plural head portions.

Further, when the water-based suspension was ejected, air was also ejected from the gas injection openings downwardly in a vertical direction, wherein the temperature of the air was 25° C., the humidity of the air was 27% RH, and the flow rate of the air was 3 m/sec. Further, the temperature of the inside of the housing (that is, the ambient temperature) was set to be 45° C., the pressure of the inside of the housing was about 1.5 kPa, and the length of the dispersion medium removal section (in the direction of conveying the dispersoid) was 1.0 m.

Furthermore, a voltage was applied to a part of the housing which constitutes the dispersion medium removal section so that an electrical potential at the side of the inner surface thereof was −200 V, thereby preventing the water-based suspension (dry fine particles) from adhering to the inner surface of the housing.

Then, the dispersion medium was removed from the ejected water-based suspension in the dispersion medium removal section to thereby obtain dry fine particles (toner particles) each having shape and size corresponding to each particle of the dispersoid. Thereafter, the dry fine particles formed in the dispersion medium removal section were collected at the cyclone.

[Preparation of Insulation Liquid]

An insulation liquid containing an unsaturated fatty acid glyceride was prepared as described below.

Firstly, 130 parts by volume of sardine oil was put into a flask. After that, 100 parts by volume of boiled water was poured into the flask, and the flask was then plugged.

Next, the flask was shaken so that the unrefined sardine oil and the boiled water were mixed. Then, the flask had been left until a mixed solution therein was separated into three layers. After it was confirmed that the mixed solution was completely separated into three layers, the flask was put in a freezer and left for 24 hours. Subsequently, an unfrozen component in the mixed solution was taken out and put into a second flask, and the unfrozen component was again subjected to the same operation as described above. Then, an unfrozen component was taken out from the second flask to obtain a roughly refined fatty oil.

Then, 100 parts by volume of the thus obtained roughly refined fatty oil and 35 parts by volume of an activated earth mainly composed of hydrous silicic aluminum were put in a flask and they were mixed and stirred.

Thereafter, the thus obtained mixture was being left for 48 hours under a pressure of 0.18 Mpa so that the activated earth was completely settled down. Then, the precipitation was removed to thereby obtain a fatty oil mainly composed of an unsaturated fatty acid glyceride.

Then, 500 parts by weight of the thus obtained fatty oil and 1 part by weight of an octylic acid zinc as the oxidation polymerization accelerator were mixed to thereby obtain an insulation liquid.

The thus obtained insulation liquid contained glycerides of oleic acid (main component), eicosapentaenoic acid, palmitoleic acid and docosahexaenoic acid as the unsaturated fatty acid glyceride, and the amount of the unsaturated fatty acid glyceride contained therein was 75 wt %. Further, the electrical resistance of the insulation liquid at room temperature (20° C.) was $2.0\times10^{13}$ Ωcm. Furthermore, the iodine value of the insulation liquid was 170.

[Dispersion of Dry Fine Particles]

501 parts by weight of the thus obtained insulation liquid, 1 part by weight of dodecyltrimethylammonium chloride as a surfactant, and 75 parts by weight of the dry fine particles were mixed and then stirred with a homomixer (PRIMIX Corporation) for 10 minutes to thereby obtain a liquid developer.

Example 2

A liquid developer was prepared in the same manner as in the Example 1 except that the oxidation polymerization accelerator was changed to one shown in Table 1 and the amount of the unsaturated fatty acid glyceride contained in the insulation liquid was changed to as shown in the Table 1 by changing the conditions for preparing the insulation liquid.

Example 3

A liquid developer was prepared in the same manner as in the Example 2 except that the oxidation polymerization accelerator was changed to one shown in the Table 1 and the oxidation polymerization accelerator which was encapsulated by the following method was used.

<Encapsulation>

First, 10 g of the oxidation polymerization accelerator was dissolved in 15 ml of acetone, and the thus obtained solution was adsorbed by a porous hydrophilic silica gel to thereby obtain core bodies. Then, 10 g of the thus obtained core bodies and 20 g of polyethylene glycol (PEG) were heated and mixed to thereby obtain a mixture thereof. Thereafter, the mixture was put into 400 ml of a solvent (AF6: Product of NIPPON MITSUBISHI OIL CORPORATION), and it was sufficiently dispersed in the solvent, then it was gradually cooled down so that PEG was settled down. Then, the solvent was removed by a filtering member to thereby obtain an oxidation polymerization accelerator with being encapsulated.

Examples 4 and 5

In each of Examples 4 and 5, a liquid developer was prepared in the same manner as in the Example 2 except that the binder resin used was changed to one shown in Table 1 and the amount of the oxidation polymerization accelerator contained in the insulation liquid was changed to as shown in the Table 1.

Example 6

A liquid developer was prepared in the same manner as in the Example 4 except that the insulation liquid used was prepared in accordance with the following manner.

Firstly, 130 parts by volume of linseed oil was put into a flask. After that, 100 parts by volume of boiled water was poured into the flask, and the flask was then plugged.

Next, the flask was shaken so that the unrefined linseed oil and the boiled water were mixed. Then, the flask was being left until a mixed solution therein was separated into three layers. After it was confirmed that the mixed solution was completely separated into three layers, the flask was put in a freezer and left for 24 hours. Subsequently, an unfrozen component in the mixed solution was taken out and put into a second flask, and the unfrozen component was again subjected to the same operation as described above. Then, an unfrozen component was taken out from the second flask to obtain a roughly refined fatty oil.

Then, 100 parts by volume of the thus obtained roughly refined fatty oil and 35 parts by volume of an activated earth mainly composed of hydrous silicic aluminum were put in a flask and they were mixed and stirred.

Thereafter, the thus obtained mixture was being left for 48 hours under a pressure of 0.18 Mpa so that the activated earth was completely settled down. Then, the precipitation was removed to thereby obtain a fatty oil mainly composed of an unsaturated fatty acid glyceride.

Then, 500 parts by weight of the thus obtained fatty oil and 1 part by weight of an octylic acid zinc as the oxidation polymerization accelerator were mixed to thereby obtain an insulation liquid.

The thus obtained insulation liquid contained glycerides of alpha-linolenic acid (main component), oleic acid, and linoleic acid as the unsaturated fatty acid glyceride, and the amount of the unsaturated fatty acid glyceride contained therein was 97 wt %. Further, the electrical resistance of the insulation liquid at room temperature (20° C.) was $2.2\times10^{13}$ Ωcm. Furthermore, the iodine value of the insulation liquid was 190.

Example 7

A liquid developer was prepared in the same manner as in the Example 6 except that the oxidation polymerization accelerator with being encapsulated used in the Example 3 was used.

Example 8

A liquid developer was prepared in the same manner as in the Example 4 except that the insulation liquid used was prepared in accordance with the following manner.

Firstly, 130 parts by volume of soy oil was put into a flask. After that, 100 parts by volume of boiled water was poured into the flask, and the flask was then plugged.

Next, the flask was shaken so that the unrefined soy oil and the boiled water were mixed. Then, the flask was being left until a mixed solution therein was separated into three layers. After it was confirmed that the mixed solution was completely separated into three layers, the flask was put in a freezer and left for 24 hours. Subsequently, an unfrozen component in the mixed solution was taken out and put into a second flask, and the unfrozen component was again subjected to the same-operation as described above. Then, an unfrozen component was taken out from the second flask to obtain a roughly refined fatty oil.

Then, 100 parts by volume of the thus obtained roughly refined fatty oil and 35 parts by volume of an activated earth mainly composed of hydrous silicic aluminum were put in a flask and they were mixed and stirred.

Thereafter, the thus obtained mixture was being left for 48 hours under a pressure of 0.18 Mpa so that the activated earth was completely settled down. Then, the precipitation was removed to thereby obtain a fatty oil mainly composed of an unsaturated fatty acid glyceride.

Then, 500 parts by weight of the thus obtained fatty oil, 1 part by weight of an octylic acid zinc as the oxidation polymerization accelerator, and 5 parts by weight of an α-tocopherol as the antioxidizing agent were mixed together to thereby obtain an insulation liquid.

The thus obtained insulation liquid contained glycerides of linoleic acid (main component), oleic acid, and α-linolenic acid (main component) as the unsaturated fatty acid glyceride, and the amount of the unsaturated fatty acid glyceride contained therein was 98 wt %. Further, the electrical resistance of the insulation liquid at room temperature (20° C.) was $2.5\times10^{13}$ Ωcm. Furthermore, the iodine value of the insulation liquid was 200.

Example 9

A liquid developer was prepared in the same manner as in the Example 8 except that the oxidation polymerization accelerator with being encapsulated used in the Example 3 was used.

Example 10

A liquid developer was prepared in the same manner as in the Example 8 except that the antioxidizing agent was changed to one shown in the Table 1.

Example 11

A liquid developer was prepared in the same manner as in the Example 9 except that the antioxidizing agent was changed to one shown in the Table 1.

Comparative Example 1

A liquid developer was prepared in the same manner as in the Example 1 except that no oxidation polymerization accelerator was used.

Comparative Example 2

A liquid developer was prepared in the same manner as in the Example 1 except that ISOPER G (product name of Exson-Mobile Corporation) was used as the antioxidizing agent.

The conditions for producing the liquid developers of the Examples 1 to 11 and the Comparative Examples 1 and 2 are shown in the following Table 1.

In this connection, it is to be noted that in the Table 1, the kinds of the fatty acids and the kinds of the antioxidizing agents used are represented by the following abbreviations.

Seiko Epson Corporation) employing the liquid developers of the Examples 1 to 11 and the Comparative Examples 1 and 2, respectively. Then, the images formed on the papers were thermally fixed onto the papers using an oven. The thermal fixing was carried out under the conditions of 120° C. for 30 minutes.

Thereafter, after it was confirmed as to whether or not a non-offset area was present, the fixed image on each of the papers was rubbed out twice using a sand eraser ("LION 261-11", Product of LION OFFICE PRODUCTS CORP.) with a pressure loading kgf/cm$^2$. Then, the residual rate of the image density of each recording paper was measured by a colorimeter "X-Rite model 404" (X-Rite Incorporated), and the measurement results were evaluated according to the following five criteria.

AA: Residual rate of the image density was 95% or higher

A: Residual rate of the image density was 90% or higher

TABLE 1

| | Resin Material | | Insulation Liquid | | | | | | | | | |
|---|---|---|---|---|---|---|---|---|---|---|---|---|
| | | | | | Oxidation Polymerization Accelerator | | | Antioxidizing Agent | | | | |
| | Kind | Softening Point [° C.] | Unsaturated Fatty Acid Kind | Unsaturated Fatty Acid Amount [Wt %] | Kind | Encapsulated or not | Amount [Wt %] | Kind | Amount [Wt %] | Iodine value | Electrical Resistance [Ωcm] | Specific Inductive Capacity |
| Ex. 1 | Epoxy Resin | 128 | OL, EPA, PT, DHA | 75 | O—Zn | No | 0.2 | — | — | 170 | $2.0 \times 10^{13}$ | 2.6 |
| Ex. 2 | Epoxy Resin | 128 | OL, EPA, PT, DHA | 92 | N—Ca | No | 0.2 | — | — | 180 | $2.0 \times 10^{13}$ | 2.6 |
| Ex. 3 | Epoxy Resin | 128 | OL, EPA, PT, DHA | 92 | L—Co | Yes | 0.2 | — | — | 180 | $2.0 \times 10^{13}$ | 2.6 |
| Ex. 4 | Polyester Resin | 124 | OL, EPA, PT, DHA | 92 | O—Zn | No | 0.05 | — | — | 180 | $2.0 \times 10^{13}$ | 2.6 |
| Ex. 5 | Styrene-Acryl Copolymer | 125.6 | OL, EPA, PT, DHA | 92 | O—Zn | No | 5.0 | — | — | 180 | $2.0 \times 10^{13}$ | 2.6 |
| Ex. 6 | Polyester Resin | 124 | LL, OL, LN | 97 | O—Zn | No | 0.2 | — | — | 190 | $2.2 \times 10^{13}$ | 2.8 |
| Ex. 7 | Polyester Resin | 124 | LL, OL, LN | 97 | O—Zn | Yes | 0.2 | — | — | 190 | $2.2 \times 10^{13}$ | 2.8 |
| Ex. 8 | Polyester Resin | 124 | LN, OL, LL | 98 | O—Zn | No | 0.2 | VE | 1.0 | 200 | $2.5 \times 10^{13}$ | 2.4 |
| Ex. 9 | Polyester Resin | 124 | LN, OL, LL | 98 | O—Zn | Yes | 0.2 | VE | 1.0 | 200 | $2.5 \times 10^{13}$ | 2.4 |
| Ex. 10 | Polyester Resin | 124 | LN, OL, LL | 98 | O—Zn | No | 0.2 | VC | 1.0 | 200 | $2.5 \times 10^{13}$ | 2.4 |
| Ex. 11 | Polyester Resin | 124 | LN, OL, LL | 98 | O—Zn | Yes | 0.2 | VC | 1.0 | 200 | $2.5 \times 10^{13}$ | 2.4 |
| Comp. Ex. 1 | Epoxy Resin | 128 | OL, EPA, PT, DHA | 75 | — | — | — | — | — | 170 | $2.0 \times 10^{13}$ | 2.6 |
| Comp. Ex. 2 | Epoxy Resin | 128 | — | — | — | — | — | — | — | — | $3.0 \times 10^{15}$ | 2.0 |

OL: oleic acid
PT: palmitoleic acid
LN: linoleic acid
LL: α-linoleic acid
DHA: docosahexaenoic acid
EPA: eicosapentaenoic acid
O—Zn: octylic acid zinc
N—Ca: naphthenic acid calcium
L—Co: linolenic acid cobalt
VE: α-tocopherol
VC: ascorbate stearic acid ester (2) Evaluation For the respective liquid developers obtained as described above, fixing strength, preservability and storage stability for a long period of time were evaluated.

(2.1) Fixing Strength

By using the image forming apparatus shown in FIG. 4, images having a predetermined pattern were formed on recording papers (High quality paper LPCPPA4 produced by B: Residual rate of the image density was 80% or higher but lower than 90%

C: Residual rate of the image density was 70% or higher but lower than 80%

D: Residual rate of the image density was lower than 70%

(2.2) Preservability

The liquid developers obtained in the Examples 1 to 11 and the Comparative Examples 1 and 2 were being placed under the atmosphere in which temperature was in the range of 15 to 25° C. for six months. Thereafter, conditions of the toner particles in the liquid developers were visually observed, and the observation results were evaluated by the following five criteria.

where $L_1$ (μm) represents the circumference of projected image of a particle that is a subject of measurement, and $L_0$ (μm) represents the circumference of a perfect circle having the same area as that of the projected image of the particle that is a subject of measurement.

TABLE 2

| | Average Roundness R | Standard Deviation Of Average Roundness | Average Diameter [μm] | Standard Deviation Of Average Diameter [μm] | Evaluation Fixing Strength | Evaluation Preservabiliy | Evaluation Storage Stability for Long Period of Time |
|---|---|---|---|---|---|---|---|
| Example 1 | 0.95 | 0.015 | 1.18 | 0.48 | A | B | B |
| Example 2 | 0.96 | 0.011 | 1.22 | 0.52 | AA | B | B |
| Example 3 | 0.95 | 0.016 | 1.17 | 0.51 | AA | B | A |
| Example 4 | 0.97 | 0.022 | 1.15 | 0.48 | A | A | B |
| Example 5 | 0.96 | 0.018 | 1.16 | 0.47 | AA | B | B |
| Example 6 | 0.97 | 0.020 | 1.17 | 0.53 | AA | AA | B |
| Example 7 | 0.96 | 0.019 | 1.20 | 0.50 | AA | AA | A |
| Example 8 | 0.97 | 0.021 | 1.18 | 0.51 | A | AA | A |
| Example 9 | 0.96 | 0.019 | 1.20 | 0.52 | A | AA | AA |
| Example 10 | 0.96 | 0.020 | 1.18 | 0.51 | AA | AA | A |
| Example 11 | 0.98 | 0.018 | 1.19 | 0.50 | AA | AA | AA |
| Comp. Ex. 1 | 0.96 | 0.155 | 1.34 | 1.22 | C | C | B |
| Comp. Ex. 2 | 0.93 | 0.080 | 1.9 | 1.36 | D | D | B |

AA: Suspension of toner particles and aggregation and settling of toner particles were not observed at all.

A: Suspension of toner particles and aggregation and settling of toner particles were scarcely observed.

B: Suspension of toner particles and aggregation and settling of toner particles were slightly observed, but they were within the practical use range of the liquid developer.

D: Suspension of toner particles and aggregation and settling of toner particles were clearly observed.

E: Suspension of toner particles and aggregation and settling of toner particles were conspicuously observed.

(2.3) Storage Stability for a Long Period of Time

The liquid developers obtained in the Examples 1-11 and the Comparative Examples 1 and 2 were being placed under the atmosphere at a temperature of 35° C. and a relative humidity of 65% for six months. Thereafter, conditions of the toner particles in the liquid developers were visually observed, and the observation results were evaluated by the following five criteria.

AA: Increased viscosity and color change of the liquid developer were not observed at all.

A: Increased viscosity and color change of the liquid developer were scarcely observed.

B: Increased viscosity and color change of the liquid developer were slightly observed, but they were within the practical use range of the liquid developer.

D: Increased viscosity and color change of the liquid developer were clearly observed.

E: Increased viscosity and color change of the liquid developer were conspicuously observed.

These results are shown in the following Table 2 together with the average roundness R, the standard deviation in the roundness, the average particle size, and the standard deviation in the particle size of the toner particles. In this connection, it is to be noted that the roundness R was measured by the use of a flow system particle image analyzer (FPIA-2000, manufactured by SYSMEX CORPORATION). The roundness R was determined by the following formula (I):

$$R=L_0/L_1 \quad (I)$$

As shown in Table 2, in the liquid developers of the present invention (that is, the liquid developers of the Examples 1 to 11), the roundness of the toner particles was high and the particle size distribution was small. Further, the toner particles had small variations in shape and size thereof (that is, the standard deviation of the roundness was small).

In contrast, in the liquid developers of the Comparative Examples 1 and 2, the toner particles had large variations in shape and size thereof. Further, in the liquid developers of the Comparative Examples, the toner particles had the unstable shapes, and the roundness thereof was low.

Further, as shown in Table 2, the liquid developers of the present invention had excellent fixing strength, excellent preservability, and excellent storage stability. In particular, the liquid developers containing both the oxidation polymerization accelerator and the antioxidizing agent (that is, the Examples 8 to 11) exhibited more excellent preservability and storage stability. Further, the liquid developers containing the oxidation polymerization accelerator with being encapsulated (that is, the Examples 3, 7, 9 and 11) also exhibited more excellent storage stability. In contrast, in the liquid developers of the Comparative Examples, satisfactory results could not be obtained.

Furthermore, liquid developers which are the same as those described above were produced excepting that as a coloring agent a pigment red 122, a pigment yellow 180, and a carbon black ("Printex L" Degussa AG) were used instead of a cyanogen-based pigment, and they were evaluated in the same manner as described above. As a result, substantially the same results could be obtained.

Moreover, liquid developers which are the same as those described above were produced using a different dry fine particle production apparatus in which the structure of the head portions was changed from the structure shown in FIG. 3 to the structure shown in each of FIGS. 7 to 10. As a result, substantially the same results could be obtained. Further, the dry fine particle production apparatuses shown in FIGS. 7 to 10 could appropriately eject a water-based suspension having relatively high concentration (dispersion liquid having high content of dispersoid) even if the diameter of the ejection portion was made small. Furthermore, in a case where a high concentration of water-based suspension was used, the time required for drying the water-based suspension could be reduced, whereby the productivity of toner particles (liquid developer) was improved.

Finally, it is to be noted that the present invention is not limited to the embodiments and the examples described above, and many additions and modifications may be made without departing from the spirit of the present invention which are defined by the following claims.

What is claimed is:

1. A liquid developer, comprises:

an insulation liquid containing as its main component a glyceride of an unsaturated fatty acid;

toner particles dispersed in the insulation liquid; and an oxidation polymerization accelerator for accelerating oxidation polymerization reaction of the glyceride during fixing process of the toner particles, wherein the oxidation polymerization accelerator is contained in the insulation liquid with being encansulated and the encapsulation of the oxidation polymerization accelerator is carried out by allowing the oxidation polymerization accelerator to be adsorbed by porous bodies and then coating the porous bodies with polyether.

2. The liquid developer as claimed in claim 1, wherein the oxidation polymerization accelerator includes a metal salt of a fatty acid.

3. The liquid developer as claimed in claim 1, wherein the amount of the oxidation polymerization accelerator contained in the insulation liquid is in the range of 0.01 to 10 wt %.

4. The liquid developer as claimed in claim 1, wherein the oxidation polymerization accelerator accelerates the oxidation polymerization reaction by supplying oxygen during the fixing process.

5. The liquid developer as claimed in claim 1, further comprising an antioxidizing agent.

6. The liquid developer as claimed in claim 5, wherein the amount of the antioxidizing agent contained in the insulation liquid is in the range of 0.01 to 10 wt %.

7. The liquid developer as claimed in claim 5, wherein the pyrolysis temperature of the antioxidizing agent is equal to or lower than a fixing temperature of the fixing process.

8. The liquid developer as claimed in claim 5, wherein the pyrolysis temperature of the antioxidizing agent is equal to or lower than 200° C.

9. The liquid developer as claimed in claim 5, wherein the antioxidizing agent includes a vitamin C.

* * * * *